US007473174B2

(12) United States Patent
Cuddy et al.

(10) Patent No.: US 7,473,174 B2
(45) Date of Patent: Jan. 6, 2009

(54) GAMING DEVICE HAVING A RE-TRIGGERING SYMBOL BONUS SCHEME WITH A BONUS SYMBOL ACCUMULATION AND PLAYER SELECTION OF ACCUMULATION TOTAL

(75) Inventors: Ryan W. Cuddy, Reno, NV (US); Zeke Brill, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 945 days.

(21) Appl. No.: 10/952,656

(22) Filed: Sep. 29, 2004

(65) Prior Publication Data

US 2005/0075163 A1 Apr. 7, 2005

Related U.S. Application Data

(63) Continuation-in-part of application No. 10/071,441, filed on Feb. 8, 2002, now Pat. No. 6,955,600, which is a continuation-in-part of application No. 09/981,133, filed on Oct. 15, 2001, now Pat. No. 6,913,532.

(51) Int. Cl.
*A63F 9/24* (2006.01)

(52) U.S. Cl. ..... 463/20; 463/16

(58) Field of Classification Search ..... 463/16, 463/20

See application file for complete search history.

(56) References Cited

U.S. PATENT DOCUMENTS 4,198,052 A 4/1980 Gauselmann (Continued)

FOREIGN PATENT DOCUMENTS

EP 0 874 337 A1 10/1998

(Continued)

OTHER PUBLICATIONS

"Money In The Bank," Konami Gaming, published in Strictly Slots, available Jun. 2001.

(Continued)

*Primary Examiner*—Corbett Coburn
*Assistant Examiner*—David W Duffy
(74) *Attorney, Agent, or Firm*—Bell, Boyd & Lloyd LLP

(57) ABSTRACT

A gaming device with an accumulator that accumulates re-triggering symbols until a pre-determined number of re-triggering symbols are obtained by the player. A variable amount of free activations as well as a variable threshold amount of re-triggering symbols are necessary to re-trigger a secondary game. The gaming device provides a plurality of player selectable selections. Each selection is associated with a number of activations of the symbol generators as well as a number of re-triggering symbols necessary to re-trigger the secondary game. If the player picked threshold of re-triggering the secondary game is satisfied (i.e., the required amount of re-triggering symbols associated with the player picked selection were accumulated during the provided amount of spins associated with the player picked selection), the gaming device subsequently re-triggers the secondary game and again provides the player a plurality of selectable selections which are each associated with a number of spins of the reels as well as a number of accumulator symbols necessary to re-trigger the secondary game.

75 Claims, 13 Drawing Sheets

U.S. PATENT DOCUMENTS

| | | | |
|---|---|---|---|
| 4,582,324 | A | 4/1986 | Koza et al. |
| 4,624,459 | A | 11/1986 | Kaufman |
| 4,695,053 | A | 9/1987 | Vazquez, Jr. et al. |
| 5,205,555 | A | 4/1993 | Hamano |
| 5,393,057 | A | 2/1995 | Marnell, II |
| 5,407,200 | A | 4/1995 | Zalabak |
| 5,423,539 | A | 6/1995 | Nagao |
| 5,449,173 | A | 9/1995 | Thomas et al. |
| 5,456,465 | A | 10/1995 | Durham |
| 5,560,603 | A | 10/1996 | Seelig et al. |
| 5,647,798 | A | 7/1997 | Falciglia |
| 5,722,891 | A | 3/1998 | Inoue |
| 5,772,506 | A | 6/1998 | Marks et al. |
| 5,775,692 | A | 7/1998 | Watts et al. |
| 5,788,573 | A | 8/1998 | Baerlocher et al. |
| 5,823,874 | A | 10/1998 | Adams |
| 5,855,514 | A | 1/1999 | Kamille |
| 5,918,880 | A | 7/1999 | Voigt, IV et al. |
| 5,935,002 | A | 8/1999 | Falciglia |
| 5,947,820 | A | 9/1999 | Morro et al. |
| 5,964,463 | A | 10/1999 | Moore, Jr. |
| 5,971,849 | A | 10/1999 | Falciglia |
| 5,980,384 | A | 11/1999 | Barrie |
| 5,988,638 | A | 11/1999 | Rodesch et al. |
| 6,003,867 | A | 12/1999 | Rodesch et al. |
| 6,004,207 | A | 12/1999 | Wilson, Jr. et al. |
| 6,012,982 | A | 1/2000 | Piechowiak et al. |
| 6,015,346 | A | 1/2000 | Bennett |
| 6,056,642 | A | 5/2000 | Bennett |
| 6,059,289 | A | 5/2000 | Vancura |
| 6,089,976 | A | 7/2000 | Schneider et al. |
| 6,102,400 | A | 8/2000 | Scott et al. |
| 6,102,798 | A | 8/2000 | Bennett |
| 6,126,542 | A | 10/2000 | Fier |
| 6,135,884 | A | 10/2000 | Hedrick et al. |
| 6,149,156 | A | 11/2000 | Feola |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,203,429 | B1 | 3/2001 | Demar et al. |
| 6,220,959 | B1 | 4/2001 | Holmes, Jr. et al. |
| 6,224,483 | B1 | 5/2001 | Mayeroff |
| 6,231,442 | B1 | 5/2001 | Mayeroff |
| 6,231,445 | B1 | 5/2001 | Acres |
| 6,234,897 | B1 | 5/2001 | Frohm et al. |
| 6,238,287 | B1 | 5/2001 | Komori et al. |
| 6,261,177 | B1 | 7/2001 | Bennett |
| 6,270,409 | B1 | 8/2001 | Shuster |
| 6,270,411 | B1 | 8/2001 | Gura et al. |
| 6,305,686 | B1 | 10/2001 | Perrie et al. |
| 6,309,300 | B1 | 10/2001 | Glavich |
| 6,311,976 | B1 | 11/2001 | Yoseloff et al. |
| 6,312,334 | B1 | 11/2001 | Yoseloff |
| 6,315,660 | B1 | 11/2001 | DeMar et al. |
| 6,315,663 | B1 | 11/2001 | Sakamoto |
| 6,328,649 | B1 | 12/2001 | Randall et al. |
| 6,340,158 | B2 | 1/2002 | Price et al. |
| 6,346,043 | B1 | 2/2002 | Colin et al. |
| 6,347,996 | B1 | 2/2002 | Gilmore et al. |
| 6,358,147 | B1 | 3/2002 | Jaffe et al. |
| 6,364,766 | B1 | 4/2002 | Anderson et al. |
| 6,364,768 | B1 | 4/2002 | Acres et al. |
| 6,368,216 | B1 | 4/2002 | Hedrick et al. |
| 6,375,187 | B1 | 4/2002 | Baerlocher |
| 6,375,567 | B1 | 4/2002 | Acres |
| 6,394,902 | B1 | 5/2002 | Glavich et al. |
| 6,398,218 | B1 | 6/2002 | Vancura |
| 6,398,644 | B1 | 6/2002 | Perrie et al. |
| 6,439,995 | B1 | 8/2002 | Hughs-Baird et al. |
| 6,443,452 | B1 | 9/2002 | Brune |
| 6,471,208 | B2 | 10/2002 | Yoseloff et al. |
| 6,481,713 | B2 | 11/2002 | Perrie et al. |
| 6,491,584 | B2 | 12/2002 | Graham et al. |
| 6,506,118 | B1 | 1/2003 | Baerlocher et al. |
| 6,533,658 | B1 | 3/2003 | Walker et al. |
| 6,537,150 | B1 | 3/2003 | Luciano et al. |
| 6,537,152 | B2 | 3/2003 | Seelig et al. |
| 6,561,904 | B2 | 5/2003 | Locke et al. |
| 6,565,436 | B1 | 5/2003 | Baerlocher |
| 6,602,137 | B2 | 8/2003 | Kaminkow et al. |
| 6,604,740 | B1 | 8/2003 | Singer et al. |
| 6,607,438 | B2 | 8/2003 | Baerlocher et al. |
| 6,632,141 | B2 | 10/2003 | Webb et al. |
| 6,648,754 | B2 | 11/2003 | Baerlocher et al. |
| 6,733,386 | B2 | 5/2004 | Cuddy et al. |
| 6,733,389 | B2 | 5/2004 | Webb et al. |
| 6,805,349 | B2 | 10/2004 | Baerlocher et al. |
| 6,869,360 | B2 | 3/2005 | Marks et al. |
| 6,913,532 | B2 | 7/2005 | Baerlocher et al. |
| 6,921,335 | B2 | 7/2005 | Rodgers et al. |
| 7,070,501 | B2 | 7/2006 | Cormack et al. |
| 2001/0009865 | A1 | 7/2001 | Demar et al. |
| 2002/0010017 | A1 | 1/2002 | Bennett |
| 2003/0060272 | A1 | 3/2003 | Glavich et al. |
| 2003/0073483 | A1 | 4/2003 | Glavich et al. |
| 2003/0162585 | A1 | 8/2003 | Bigelow et al. |
| 2004/0053672 | A1 | 3/2004 | Baerlocher |
| 2004/0147306 | A1 | 7/2004 | Randall et al. |
| 2005/0049035 | A1 | 3/2005 | Baerlocher et al. |
| 2005/0070354 | A1 | 3/2005 | Baerlocher et al. |
| 2005/0233801 | A1 | 10/2005 | Baerlocher |
| 2005/0266917 | A1 | 12/2005 | Glavich et al. |

FOREIGN PATENT DOCUMENTS

| | | |
|---|---|---|
| EP | 0874337 | 10/1998 |
| EP | 0 981 119 A2 | 2/2000 |
| EP | 0981119 | 2/2000 |
| GB | 2 322 217 A | 8/1998 |
| GB | 2322217 | 8/1998 |
| WO | 0032286 | 6/2000 |
| WO | WO 00/32286 | 6/2000 |
| WO | WO 01/26019 A1 | 4/2001 |

OTHER PUBLICATIONS

Addams Family Article written by IGT, published in 2000.
Dolphin Treasure Advertisement written by Aristocrat Leisure Industries Pty. Ltd, published in 1996.
Ghoulish Gamble Advertisement written by Strictly Slots, published in Nov. 2000.
Top Dollar Advertisement written by IGT, published in 1998.
Triple Bucks Advertisement written by IGT, published in 1999.
Catch A Wave Advertisement written by IGT, published in Dec. 2000.
Spin Til You Win Game Description written by IGT, published in 1996.
Winning Bid Advertisement, written by WMS Gaming, published prior to Jan. 2001.

GAMING DEVICE HAVING A RE-TRIGGERING SYMBOL BONUS SCHEME WITH A BONUS SYMBOL ACCUMULATION AND PLAYER SELECTION OF ACCUMULATION TOTAL

PRIORITY CLAIM

This application is a continuation-in-part application of U.S. patent application Ser. No. 10/071,441, filed on Feb. 8, 2002, now U.S. Pat. No. 6,955,600, the entire contents of which are incorporated herein, which is a continuation-in-part application of U.S. patent application Ser. No. 09/981,133, filed on Oct. 15, 2001, now U.S. Pat. No. 6,913,532, the entire contents of which are also incorporated herein.

This application relates to the following co-pending commonly owned applications: "GAMING DEVICE HAVING FREE GAMES BONUS WITH A CHANGING MULTIPLIER," Ser. No. 10/086,146, "GAMING DEVICE HAVING A BONUS GAME WITH MULTIPLE PLAYER SELECTABLE AWARD OPPORTUNITIES," Ser. No. 10/237,207, "GAMING DEVICE HAVING BONUS GAME WITH MULTIPLE PLAYER SELECTABLE AWARD OPPORTUNITIES," Ser. No. 10/660,076, "GAMING DEVICE HAVING SEQUENTIAL ACTIVATIONS OF A GAME AND REPLAY OF PREVIOUS ACTIVATIONS OF THE GAME," Ser. No. 10/956,508, "GAMING DEVICE WITH CHANGING WILD SYMBOLS," Ser. No. 10/956,303, "GAMING DEVICE HAVING FREE SPIN MODE WITH SYMBOL ELIMINATION," Ser. No. 10/953,818, "GAMING DEVICE HAVING A RE-TRIGGER SYMBOL BONUS SCHEME," Ser. No. 11/156,112, and "GAMING DEVICE HAVING A RE-TRIGGERING SYMBOL BONUS SCHEME WITH A BONUS SYMBOL ACCUMULATOR," Ser. No. 11/196,930.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device, and more particularly to a gaming device having a re-triggering symbol bonus scheme with a bonus symbol accumulator and player selection of accumulation total.

The base or primary game of most slot machines involves one or more mechanical or video spinning reels, each of which display a plurality of symbols. In many such games, a triggering event such as a symbol or combination of symbols yield one or more opportunities or chances in a bonus or secondary game, which is played in addition to the base game.

It is desirable to provide players with new and different gaming devices with new and different bonus schemes for the enjoyment and entertainment of players.

SUMMARY OF THE INVENTION

One embodiment of the present invention provides a gaming device having a slot base game and a slot bonus game wherein one or more bonus triggering symbols in the base game are employed as bonus re-triggers in the bonus game. In one preferred embodiment, the occurrence of a predetermined combination of a plurality of bonus triggering symbols (such as three bonus triggering symbols along a payline) in a base game triggers a corresponding bonus game. In that bonus game, the same bonus triggering symbols in any position (i.e., a scatter pay) functions as the bonus re-trigger in the bonus game which causes one or more additional activations of the reels or one or more re-triggers of that entire bonus game. The probability of obtaining the bonus re-trigger in the bonus game which is based on the same bonus symbols needed to trigger the bonus game in the base game is greater than the probability of obtaining the bonus trigger in the base game because the combination of bonus triggering symbols can occur anywhere on the reels in the bonus game to cause the bonus re-trigger (i.e., a scatter pay).

Accordingly, the present invention provides a gaming device, which includes a symbol or symbol combination in a primary or base game which triggers a secondary or bonus game, and a symbol or symbol combination in the secondary or bonus game which is more likely to occur in the bonus game and which re-triggers the secondary or bonus game or a portion thereof. More generally, the present invention provides a gaming device which includes a bonus triggering event in a primary or base game which triggers a secondary or bonus game and a bonus re-triggering event in the secondary or bonus game which re-triggers the secondary or bonus game or a portion thereof. The bonus triggering event in the primary or base game and the bonus re-triggering event in the secondary or bonus game preferably employ the same symbols or symbol combinations such that the bonus re-triggering event in the secondary or bonus game is more likely to occur in the bonus game than the bonus triggering event in the primary or base game.

The bonus re-trigger in the bonus game may, for instance, provide the player a bonus game extension such as additional or free spins in the bonus game, a replay of the entire bonus game, or a modification to the bonus game such as changing the bonus re-triggering symbol or bonus re-triggering combination of symbols in the bonus game. The bonus-retrigger can alternatively cause other changes in the bonus game as desired by the game implementor. For instance, the bonus re-trigger may cause a modification of the bonus award pay scale or table such as doubling or tripling subsequent award values in the bonus game.

In an alternative embodiment of the present invention, an accumulator accumulates bonus triggering symbols until a pre-determined number of secondary game or bonus re-triggering symbols are obtained by a player in the secondary game or bonus game. The accumulated bonus re-triggering symbols are in one embodiment, preferably the same symbol. Additionally, the bonus re-triggering symbols in the bonus game may be the same symbol as the bonus triggering symbol in the primary game or a different symbol. The accumulator preferably accumulates bonus re-triggering symbols in conjunction with one or more bonus re-triggering events. Once the accumulator accumulates the predetermined number of bonus re-triggering symbols in the bonus game, the gaming device provides the player with a bonus re-trigger. The re-triggering of the bonus game includes at least one re-trigger of the bonus game, at least one additional spin in the bonus game, at least one additional turn, or any combination thereof.

In a further embodiment, the gaming device provides a bonus re-trigger to the player when the accumulator accumulates the bonus triggering symbols in a pre-determined order in the bonus game. In this embodiment, the bonus re-triggering symbols are preferably accumulated one at a time. Alternatively, the symbols may be accumulated in one or more turns.

In yet another embodiment, the gaming device provides a bonus retrigger to the player when the accumulator accumulates a predetermined number of activated bonus triggering symbols.

In another embodiment, the present invention provides a variable amount of free spins or free activations as well as a variable threshold amount of accumulator or re-triggering symbols that are necessary to re-trigger a secondary game. In one embodiment, the gaming device provides a plurality of player selectable selections. Each selection is associated with a number of spins or activations of the symbol generators or reels as well as a number of accumulator or re-triggering symbols necessary to re-trigger the secondary game. For example, one selection may be associated with eight spins and three required accumulator symbols and another selection may be associated with five spins and two required accumulator symbols.

In this embodiment, the gaming device enables the player to pick one of the selections and the gaming device reveals the number of spins of the reels as well as a number of accumulator or re-triggering symbols necessary to re-trigger the secondary game associated with the player picked selection. It should be appreciated that the player picked selection sets or establishes a secondary game re-triggering threshold (i.e., the number of accumulator or re-triggering symbols necessary to re-trigger the secondary game) and also sets or establishes the number of attempts or opportunities provided to satisfy the secondary game re-triggering threshold (i.e., the number of spins of the reels for accumulating accumulator or re-triggering symbols). In this example, if the player picks the selection associated with the eight spins and the three required accumulator symbols, the gaming device provides the player eight spins or activations of the reels wherein three accumulator symbols must be accumulated during the eight provided spins to cause a re-triggering of the secondary game. On the other hand, if the player picks the selection associated with five spins and two required accumulator symbols, the gaming device provides the player five spins or activations of the reels wherein two accumulator symbols must be accumulated during the five provided spins to cause a re-triggering of the secondary game. It should be appreciated that the present invention provides a plurality of different player selectable secondary game re-triggering thresholds wherein at least one of the thresholds must be satisfied to cause a re-triggering of the secondary game.

In one embodiment, if the player picked threshold of re-triggering the secondary game is satisfied (i.e., the required amount of accumulator symbols associated with the player picked selection were accumulated during the provided amount of spins associated with the player picked selection), the gaming device again provides the player a plurality of selectable selections which are each associated with a number of spins of the reels as well as a number of accumulator symbols necessary to re-trigger the secondary game. The player picks one of the selections and the gaming device proceeds with providing the player the number of spins associated with the player picked selection and determining if, based on the amount of re-triggering symbols accumulated during the provided number of spins, a re-triggering of the secondary game occurs as described above. On the other hand, if the player picked threshold of re-triggering the secondary game is not satisfied, the gaming device provides the player any awards obtained during the provided number of spins associated with the player picked selection and ends the secondary game without providing any subsequent secondary games. In other words, the present invention provides a game wherein the satisfaction of a player selected secondary game re-triggering threshold causes at least a portion of or the entire secondary game to be repeated or re-triggered at least once.

In one embodiment, after a designated number of re-triggers of the secondary game, the gaming device displays to the player a plurality of symbols. Each of the symbols is associated with a modifier, such as a multiplier. In this embodiment, the gaming device enables the player to pick one of the symbols and the gaming device reveals the modifier associated with the player picked symbol. Any awards obtained in the secondary game are modified by the revealed modifier and the secondary game ends without a subsequent re-triggering of the secondary game. Thus, this embodiment provides a limit or cap to the number of times the secondary game may be sequentially re-triggered.

It is therefore an advantage of the present invention to provide a gaming device having a triggering symbol bonus scheme.

It is another advantage of the present invention to provide a gaming device having a re-triggering symbol bonus scheme in conjunction with other re-triggering symbol bonus schemes.

Other features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
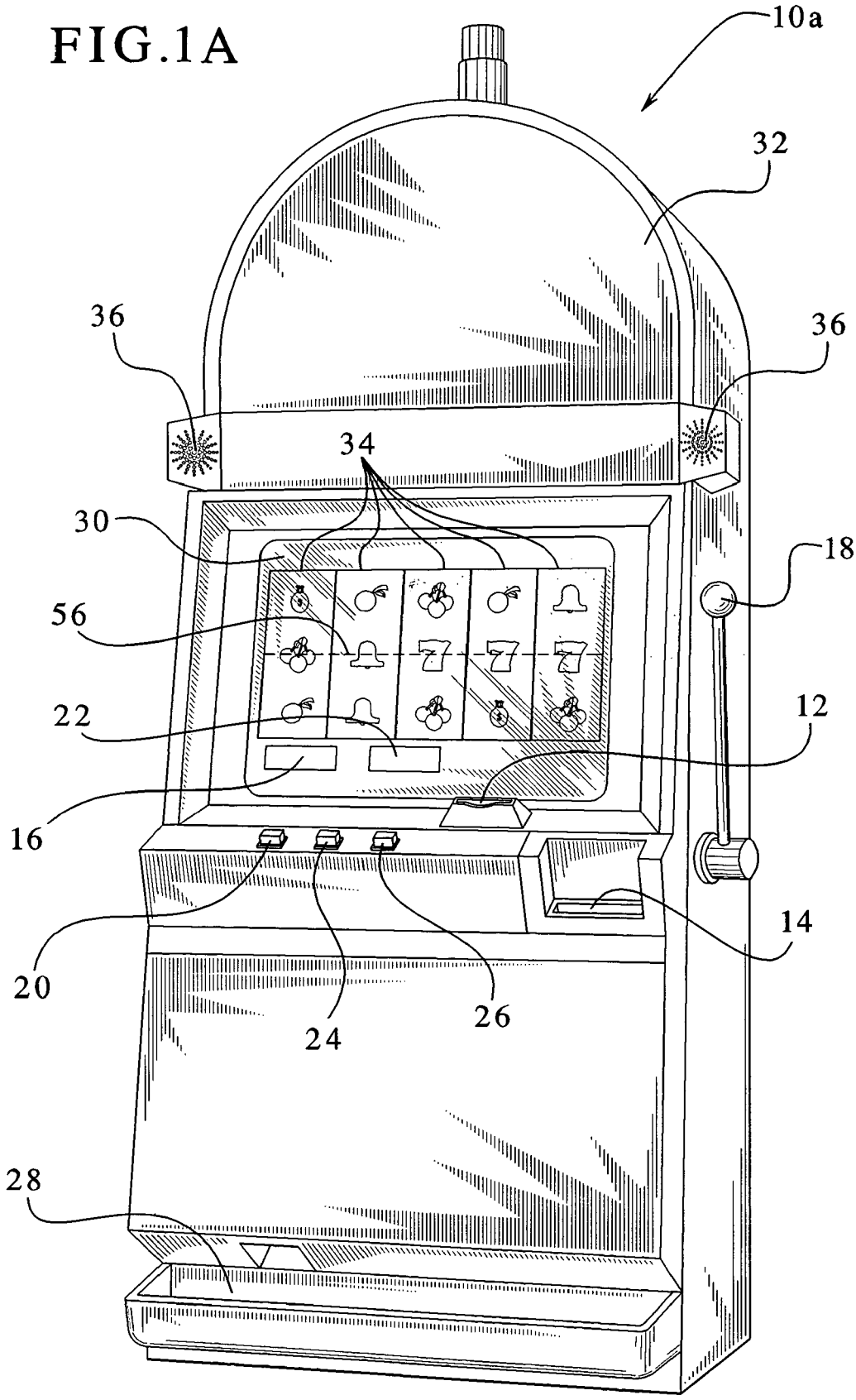
FIG. 1A is a front elevation view of a general embodiment of the gaming device of the present invention.
Figure 1B:
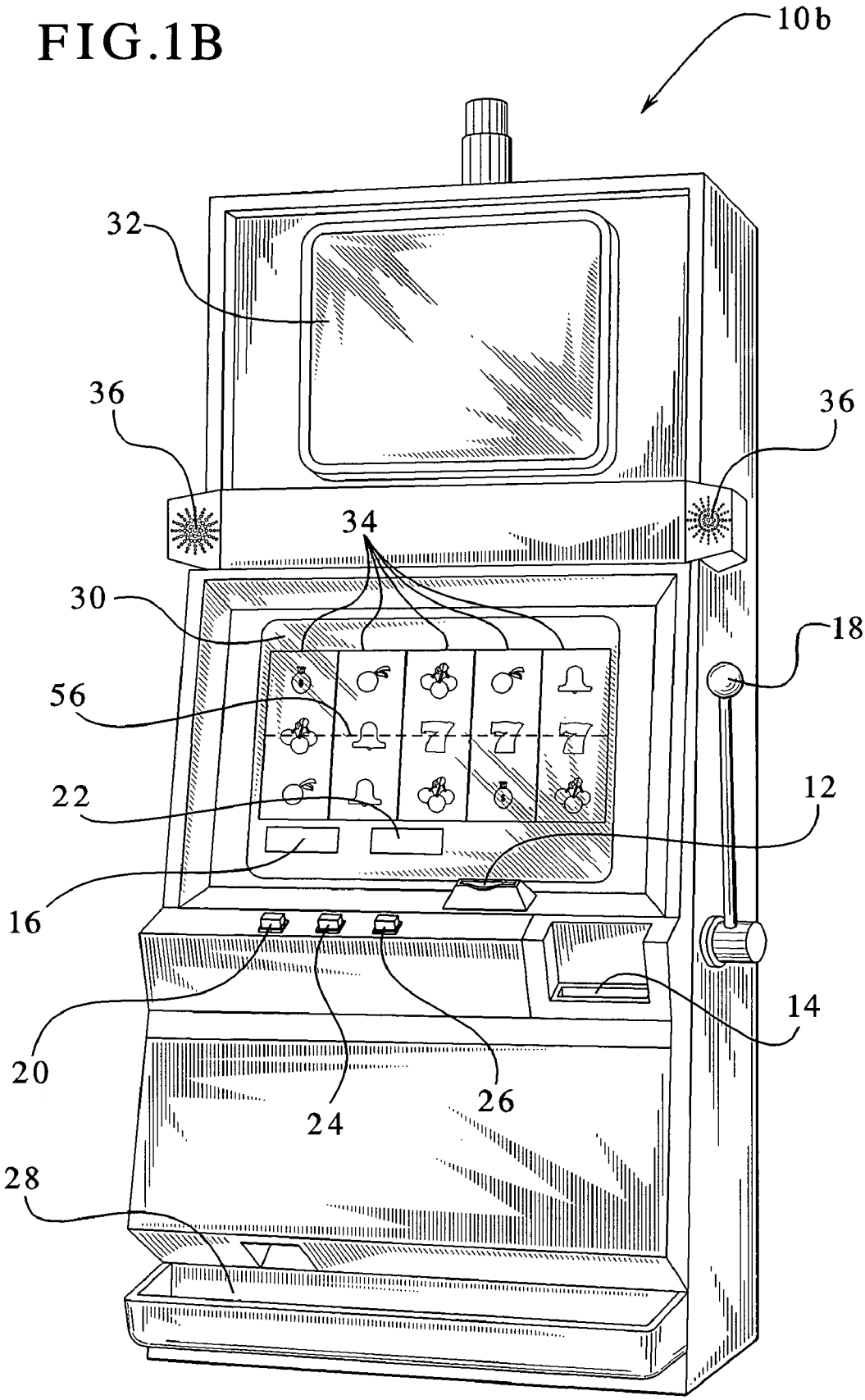
FIG. 1B is a front elevation view of a second embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and is preferably mounted in a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 may be adapted to incorporate any primary game such as slot, poker, blackjack, keno, or any of the bonus triggering events and any of the bonus round games associated with these games, in conjunction with the present invention. The symbols and indicia used on and in gaming device 10 may be in mechanical, electronic, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device may also include a conventional bet maximum button (not shown) and conventional payline bet buttons.

A player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 in one embodiment displays a plurality of reels 34 such as three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia or symbols such as bells, hearts, fruits, numbers, letters, bars or other images or symbols which preferably correspond to a theme associated with the gaming device 10. Furthermore, gaming device 10 preferably includes speakers 36 for making sounds or playing music.

Figure 2:
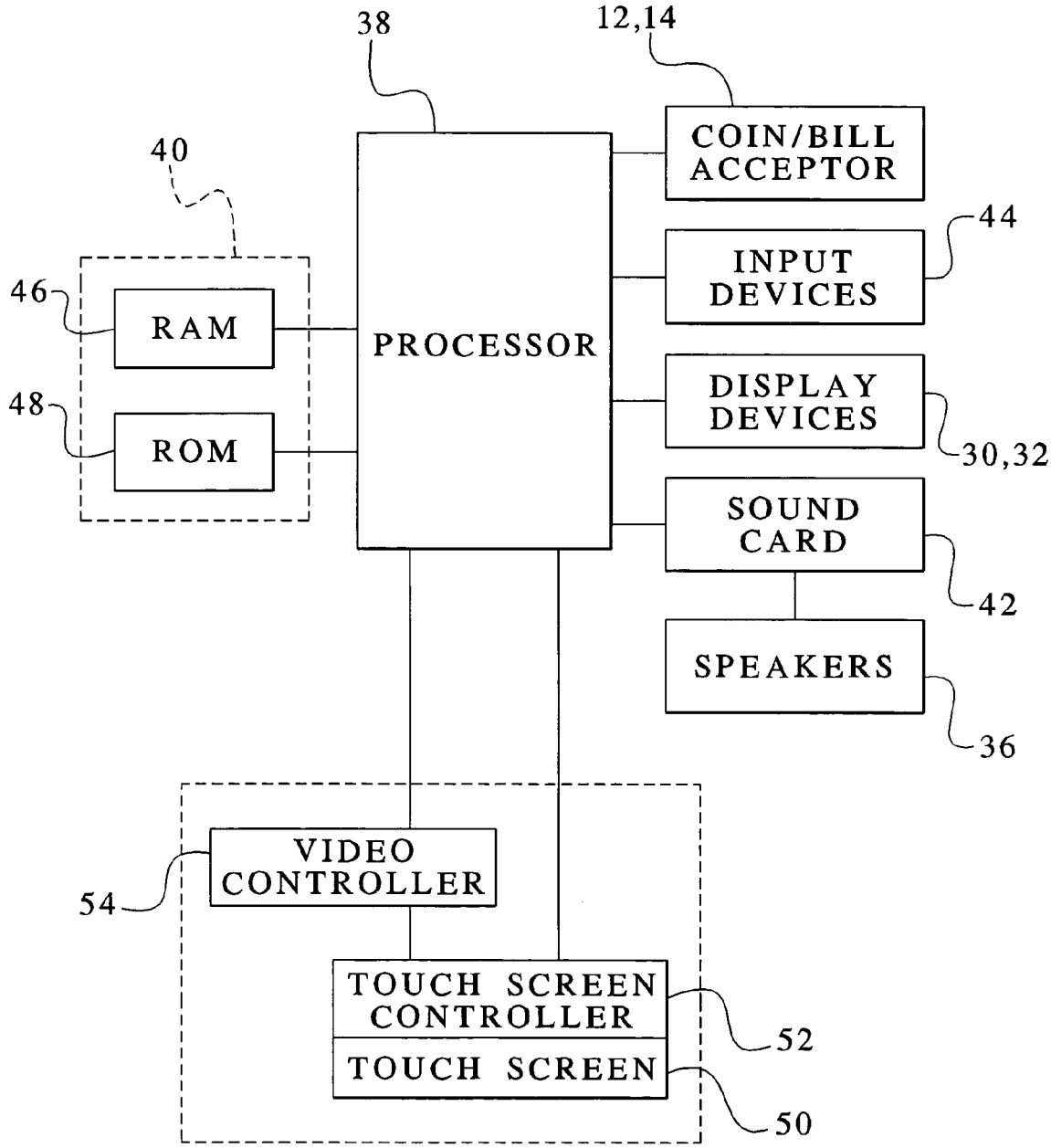
FIG. 2 is a schematic block diagram of the electronic configuration of one embodiment of the gaming device of the present invention.

As illustrated in FIG. 2, the general electronic combination of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The processor may include a main processor and a sub-processor which control certain features of the gaming device in conjunction with the main processor. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer' or "controller." With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device as discussed in detail below. The gaming device 10 in one embodiment uses a video-based central display device 30 to enable the player to play the bonus round. In one embodiment as discussed below, the qualifying condition is a predetermined combination of indicia or symbols appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Re-Trigger

Figure 3A:
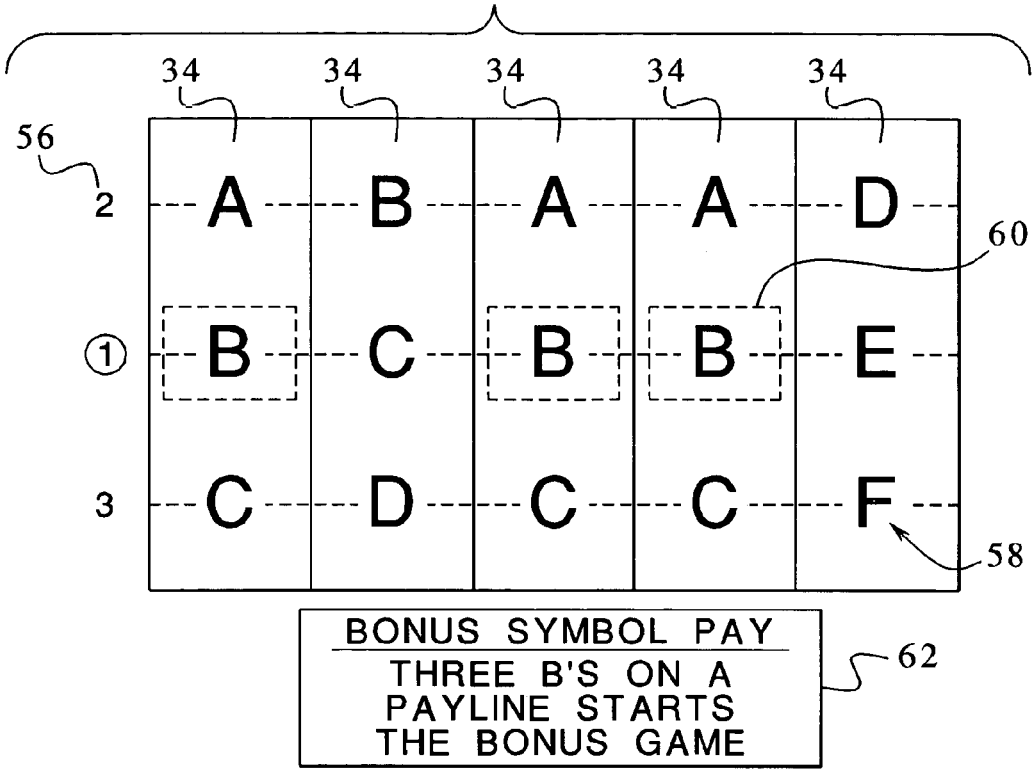
FIG. 3A is an enlarged front elevation view of one of the display devices of FIGS. 1A and 1B showing an embodiment of a bonus triggering symbol combination.

Referring now to FIG. 3A, a set of mechanical or video reels 34 is generally illustrated having symbols 58 designated as A through F. It should be appreciated that any suitable set of symbols could be used as the symbols 58 in accordance with the present invention. In this embodiment, the "B" symbols 60 are the bonus symbols and the appearance of three "B" symbols on any activated payline such as payline 1, triggers a bonus game as indicated by bonus display 62. Although in this example three "B" symbols are used to trigger the bonus game, it should be appreciated that any symbol combination having the same symbol or designated symbols may be used as the bonus triggering combination.

Figure 3B:
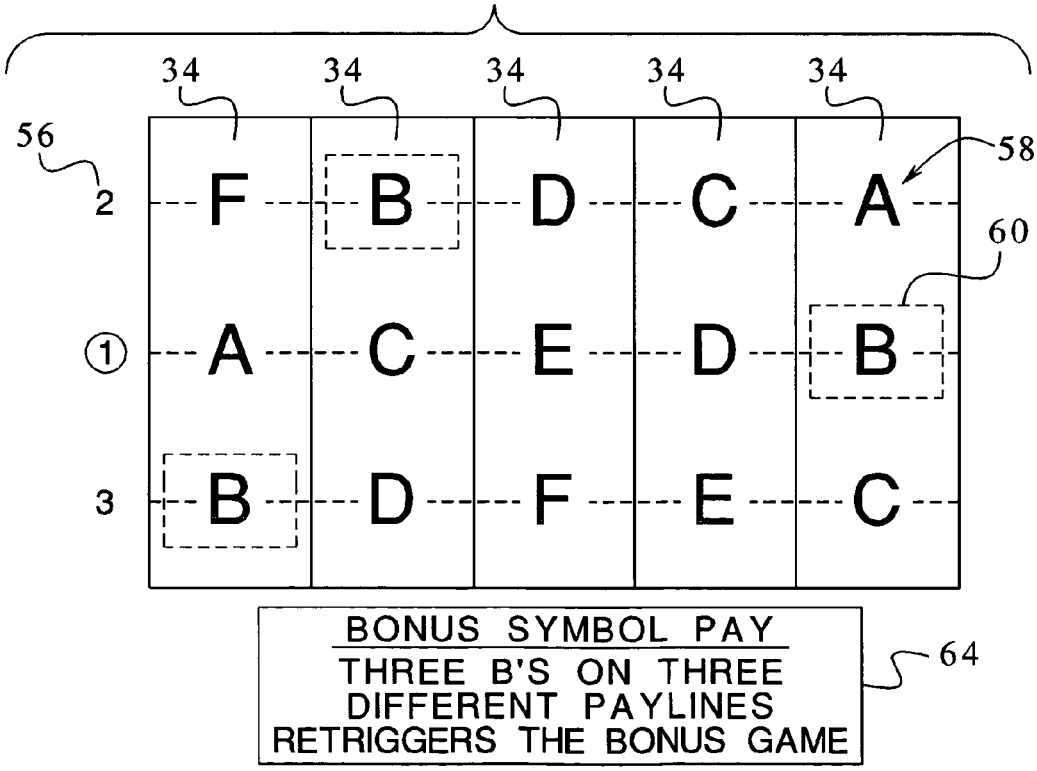
FIG. 3B is an enlarged front elevation view of one of the display devices of FIGS. 1A and 1B illustrating a bonus re-trigger symbol combination in a bonus game.

FIG. 3B illustrates one embodiment of the bonus game of the present invention where the bonus re-trigger occurs in the bonus game when the same symbols, which trigger the bonus game in the base game, are displayed in a scattered combination on multiple paylines. In this embodiment, the "B" symbol 60 is the bonus re-trigger symbol and any three "B" symbols on three paylines provides the bonus re-trigger in the bonus game as described in bonus display 64. Accordingly, as described above, in accordance with the present invention, the bonus re-trigger will occur more frequently than the bonus trigger because the bonus trigger will only occur when the bonus triggering symbols are aligned along a payline. The bonus re-trigger, however, will occur when the bonus triggering symbols are aligned along a payline or when the bonus triggering symbols occur along any payline.

Figure 4:
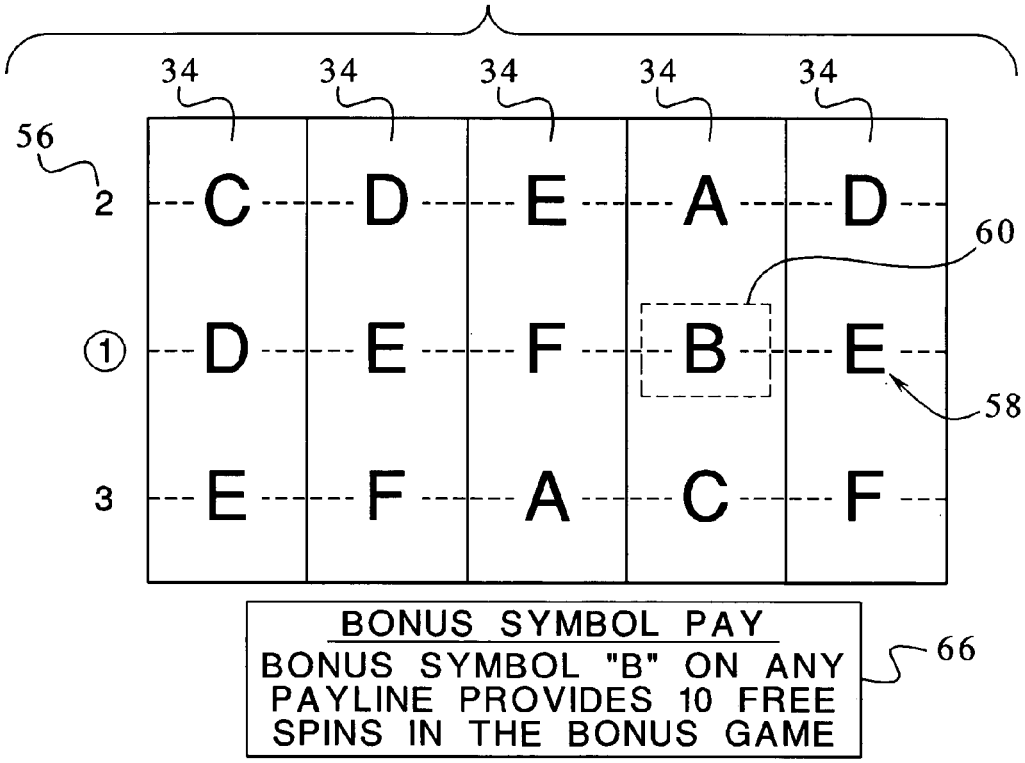
FIG. 4 is an enlarged front elevation view of one of the display devices of FIGS. 1A and 1B illustrating a bonus re-trigger in a bonus game where a player receives additional spins.

Referring now to FIG. 4, one embodiment of the present invention is shown where the bonus re-trigger occurs when one bonus triggering symbol occurs. In this example, the bonus game was triggered by obtaining a predetermined combination of the bonus symbols "B" 60 as illustrated in FIG. 3A, for instance. The bonus triggering symbol "B" is the bonus re-trigger symbol in the bonus game. In other words, any one of the bonus symbols "B" which in combination trigger the bonus game in the base game, is the symbol in the bonus game which provides a bonus re-trigger in the bonus game. In one embodiment, only one bonus symbol 60 located on any payline 56 is required to obtain a bonus re-trigger in the bonus game. It should be appreciated, however, that any combination of the same bonus symbols, which is more likely to occur in the bonus game than in the primary game, may be used to obtain a bonus re-trigger in the bonus game in accordance with the present invention. Thus, the present invention provides a bonus game which increases the chances of obtaining a bonus re-trigger using the same primary symbols by requiring less of those symbols in the bonus game to obtain a bonus re-trigger than in the primary game, or by requiring a more likely to occur combination of those symbols in the bonus game to obtain are-trigger in the bonus game. Returning now to FIG. 4, the appearance of bonus symbol "B" 60 in the bonus game, causes a bonus re-trigger for the player in the bonus game. The bonus re-trigger is 10 free spins in the bonus game as designated by the bonus display 66.

Figure 5A:
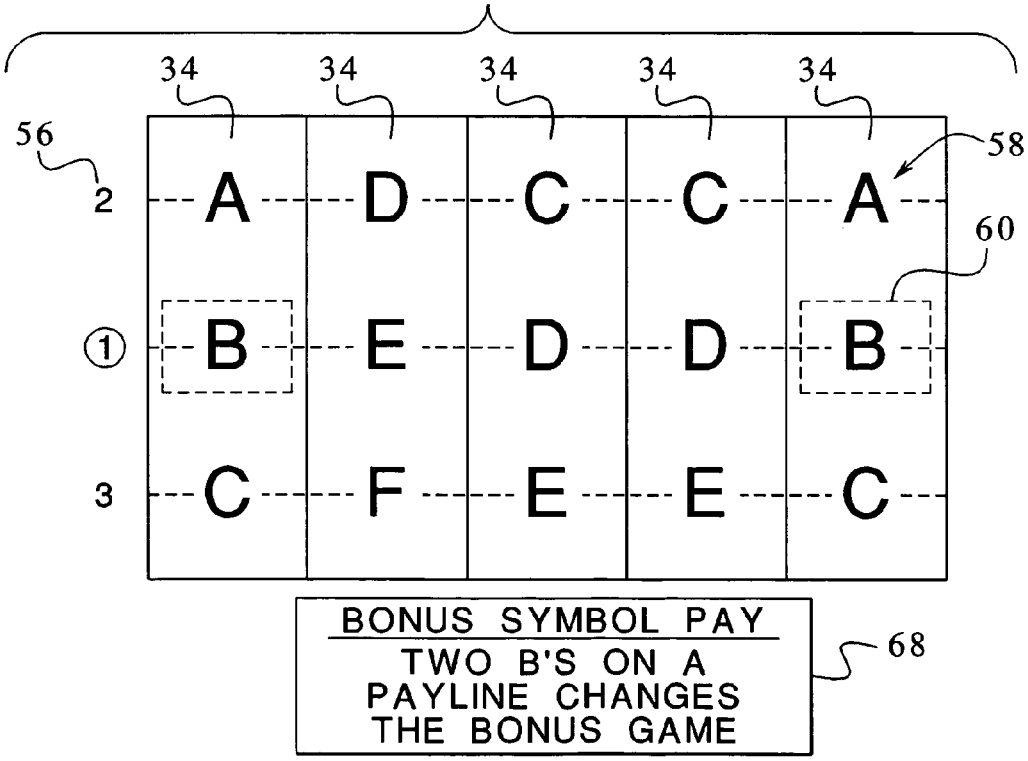
FIG. 5A is an enlarged front elevation view of one of the display devices of FIGS. 1A and 1B showing a bonus re-trigger where the bonus re-triggering combination is two "B" symbols on a payline.
Figure 5B:
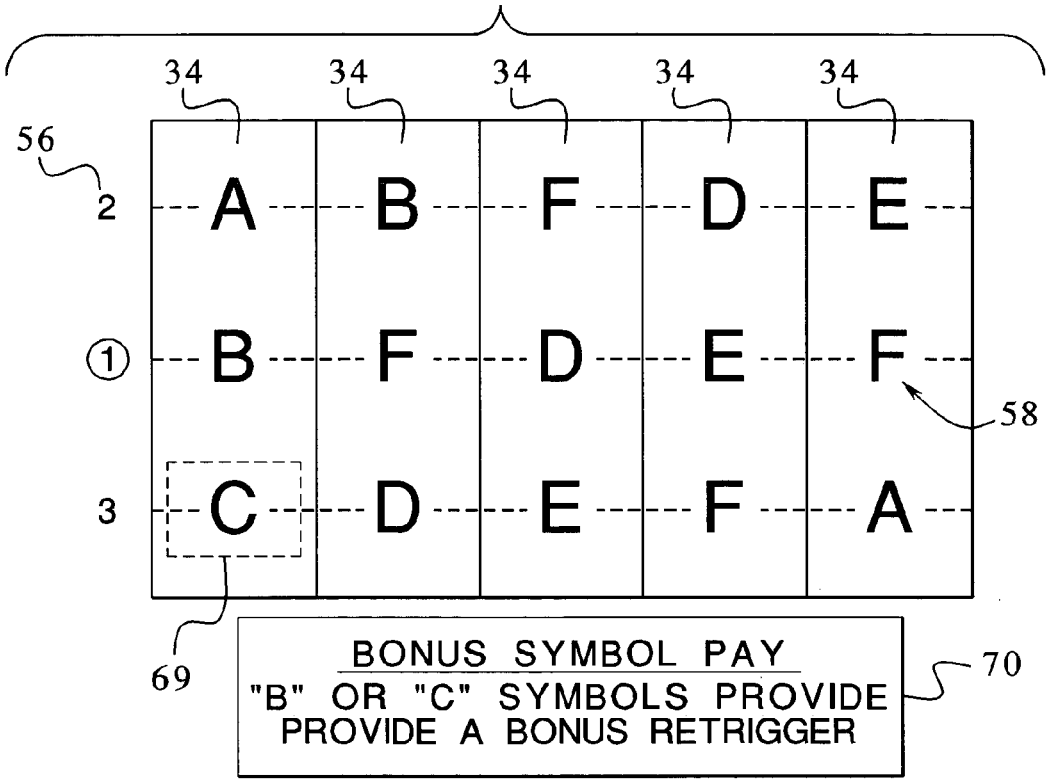
FIG. 5B is an enlarged front elevation view of one of the display devices of FIGS. 1A and 1B illustrating a bonus re-trigger where the bonus re-triggering symbol is a different symbol.

Another embodiment of the present invention is illustrated in FIGS. 5A and 5B. In this embodiment, the bonus re-trigger restructures or changes how the bonus game is subsequently re-triggered, initiated, played or the structure or type of the bonus game. Initially, the bonus game was triggered by obtaining three "B" symbols along a payline as shown in FIG. 3A, for instance. The bonus symbol "B" triggers the bonus re-trigger in the bonus game, which in this case, changes the bonus game re-triggering symbol combination or event.

In FIGS. 5A and 5B, a player obtains two "B" symbols which changes the bonus re-triggering symbol or bonus mode. In one embodiment, the probability of obtaining the bonus re-triggering symbol becomes even greater. FIG. 5A illustrates one embodiment where the player obtains two "B" symbols 60 on one payline 56 in the bonus game which changes the bonus game as indicated by bonus display 68. This changes the bonus game to include another bonus re-triggering symbol "C."

In FIG. 5B, the bonus re-triggering symbol also now includes the "C" symbol 69 on any payline as described in bonus display 70. Since the bonus retrigger symbols now also includes the "C" symbol 69, the player has a better chance of obtaining the bonus re-trigger because both the "B" symbol and the "C" symbol now provide the bonus re-trigger in this new, modified, or changed bonus game. The bonus re-trigger could be for instance, additional spins of the reels wherein a player can obtain bonus awards. The new bonus game could also change the paylines or other functions of the game, increase or decrease the number of reels in the base game, or change to an entirely new bonus game.

Figure 6:
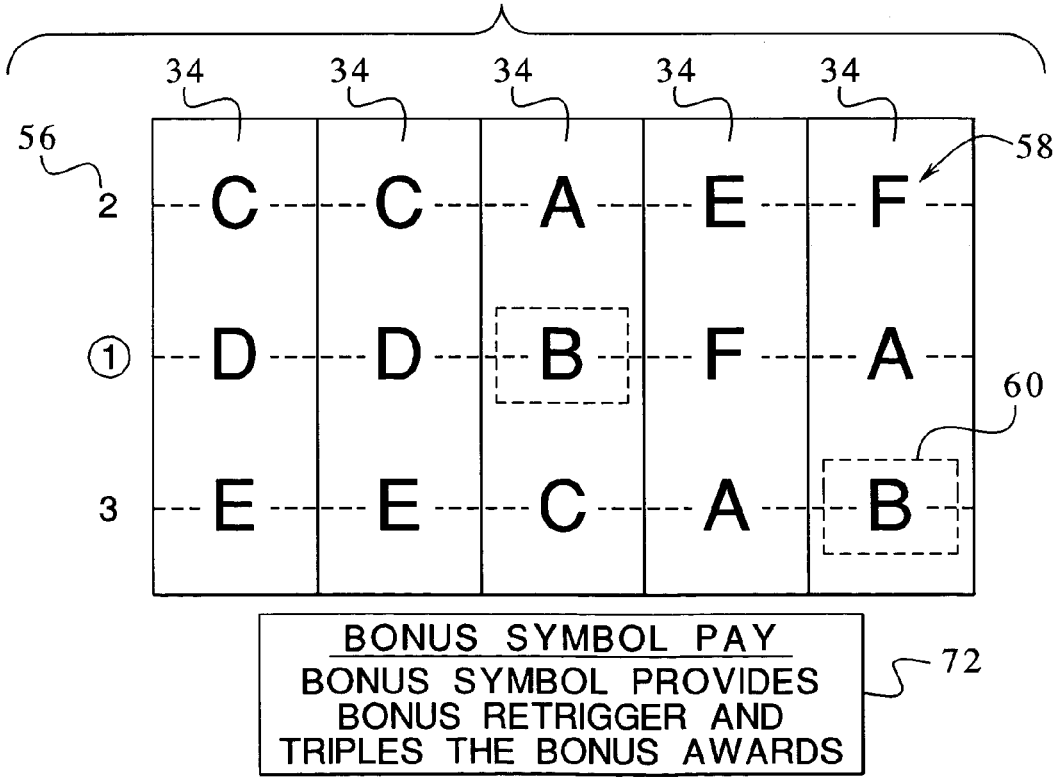
FIG. 6 is an enlarged front elevation view of one of the display devices of FIGS. 1A and 1B wherein the bonus re-trigger includes an award modification.

Referring now to FIG. 6, another embodiment of the present invention is shown where the bonus re-trigger additionally changes or modifies an award in the bonus game. In FIG. 6, the player entered the bonus game by obtaining a bonus triggering event that included three bonus symbols "B," designated by the numeral 60. The bonus symbol "B" is the bonus re-triggering symbol in the bonus game. The player obtains the bonus re-triggering symbol "B" on paylines one and three. Thus, the player receives the bonus re-trigger and a modification of the award provided to the player in the bonus game as described by bonus display 72, which includes tripling the bonus award values. It should be appreciated that any modifications of the bonus award values may be made including, but not limited to, multiplying the values by some factor or increasing the bonus award values by a fixed amount.

Figure 7A:
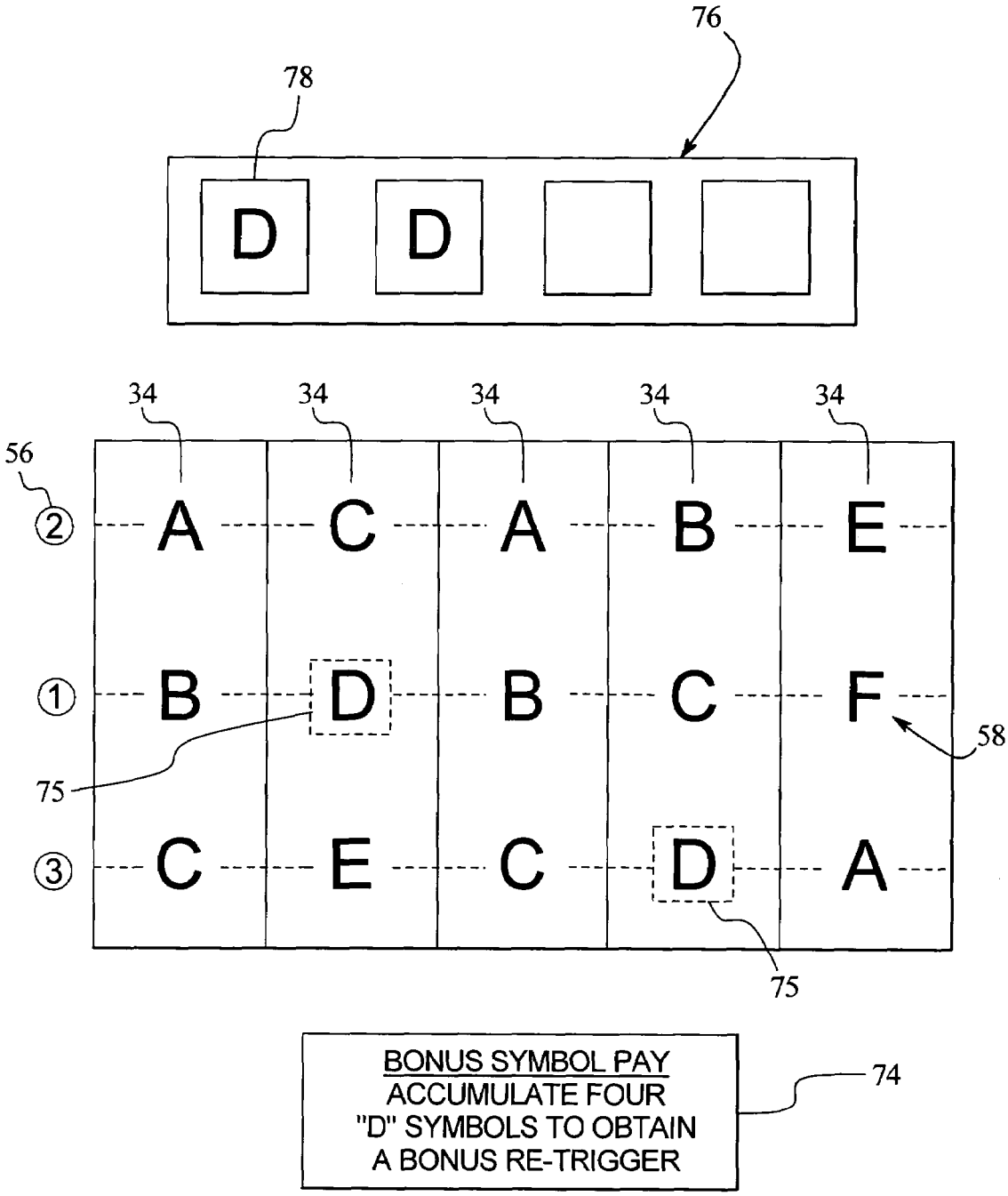
FIGS. 7A, 7B and 7C are enlarged front elevation views of one of the display devices of FIGS. 1A and 1B showing an alternative embodiment of the present invention where a player obtains a bonus re-trigger when the player accumulates four "D" symbols.
Figure 7B:
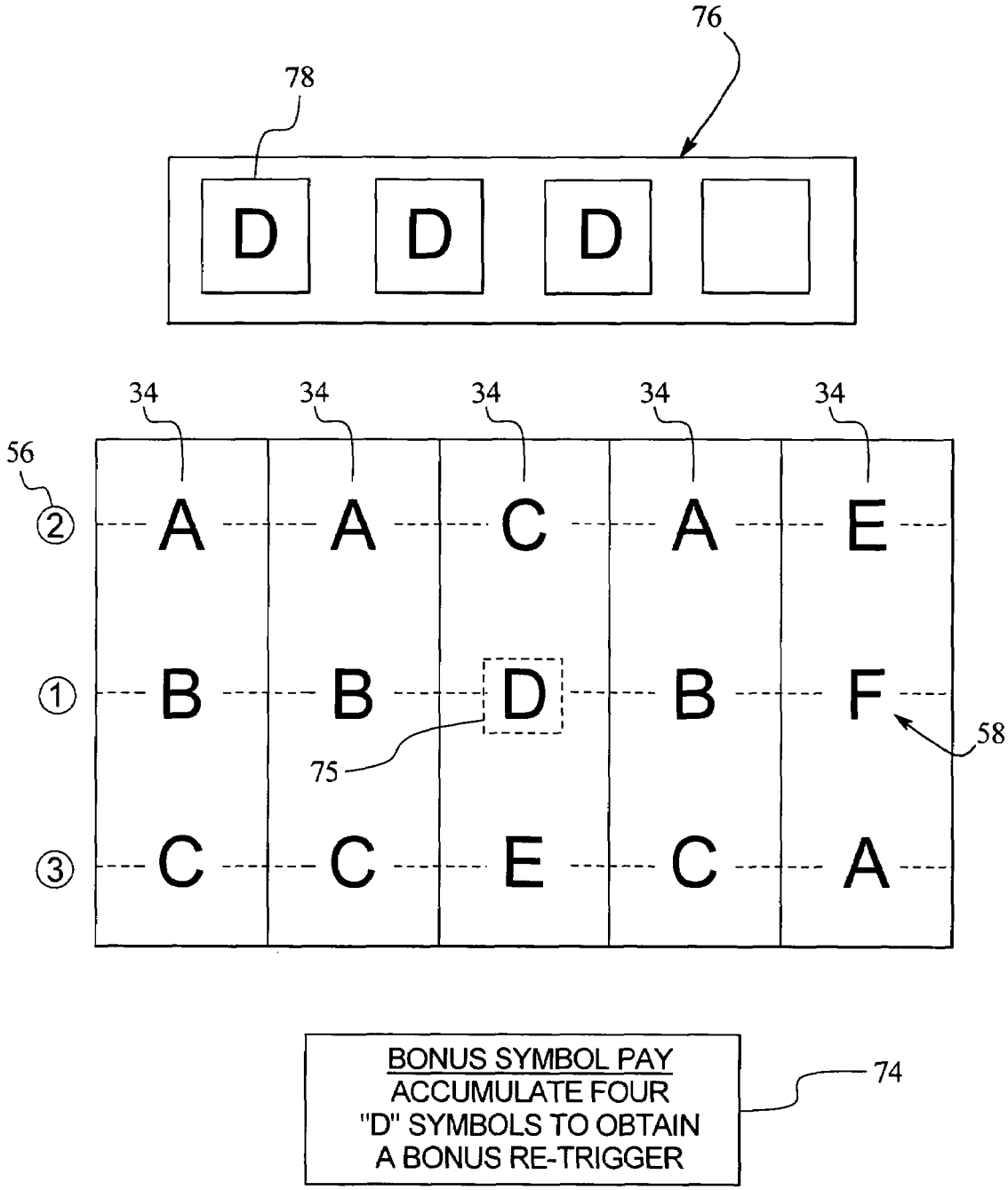
Figure 7C:
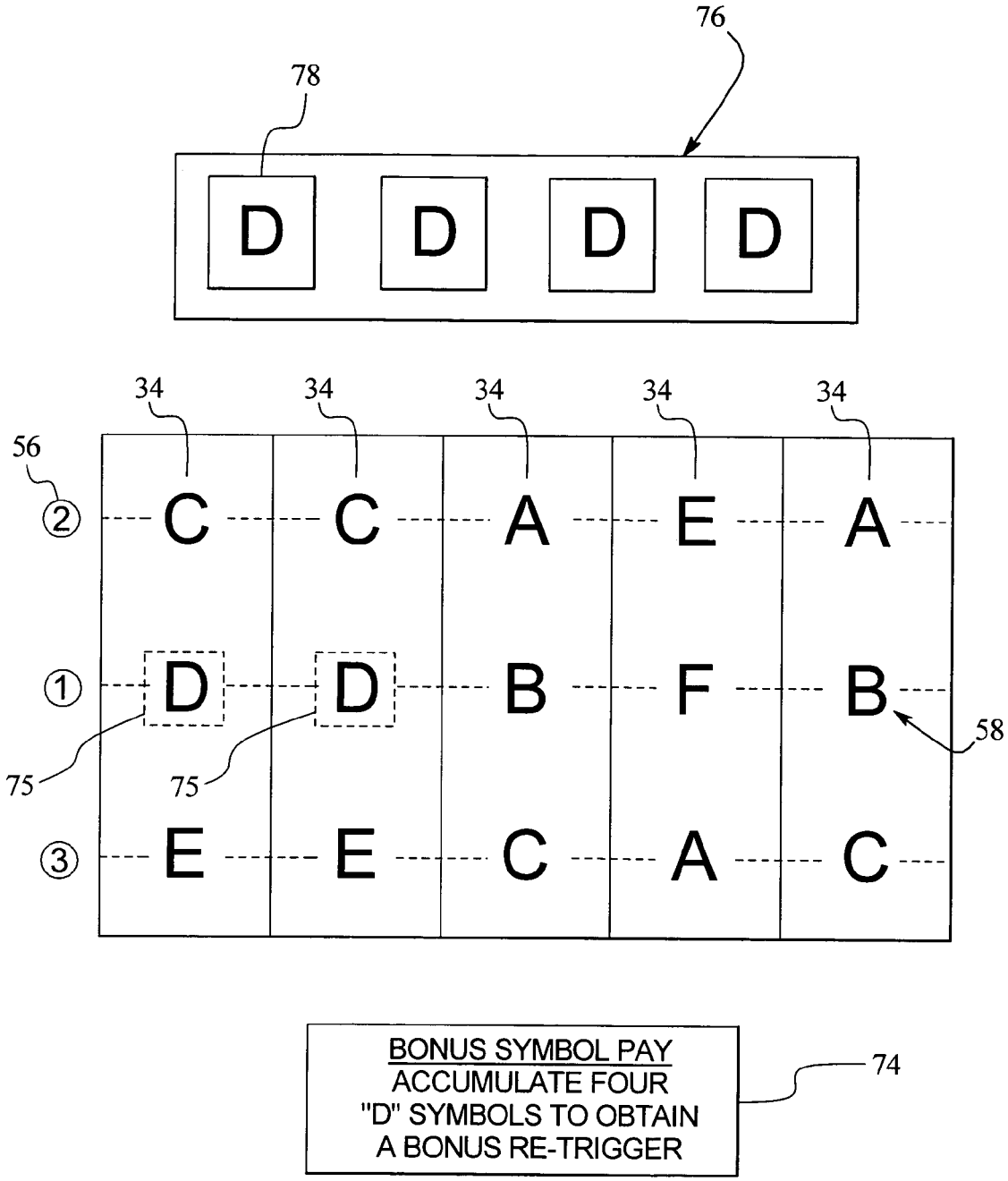

In another embodiment of the present invention illustrated in FIGS. 7A, 7B and 7C, an accumulator accumulates bonus re-triggering symbols until a pre-determined number of bonus re-triggering symbols are obtained by the player in the bonus game. In one embodiment, the player accumulates the same bonus re-triggering symbol to re-trigger the bonus game. It should be appreciated that the bonus re-triggering symbols needed to re-trigger the bonus game may include the same bonus re-triggering symbol, a plurality of the same bonus re-triggering symbols or different bonus re-triggering symbols. The bonus re-triggering symbol in the bonus game may be the same symbol as the bonus triggering symbol in the primary game or a different symbol.

It should be appreciated that the number of bonus re-triggering symbols needed to re-trigger the bonus game may also be randomly determined by the processor. In this embodiment, a probability of being selected by the processor is associated with the number of bonus re-triggering symbols to be accumulated by the accumulator when the number is randomly determined by the processor.

In FIGS. 7A, 7B and 7C, the bonus re-triggering symbol in the bonus game is the same as the bonus triggering symbol in the primary game. The player entered the bonus game by obtaining a bonus triggering event that included three "D" symbols, designated by the numeral 75. In the bonus game, the player must accumulate four "D" symbols in one or more of the free spins of the reels, provided to the player during the bonus game, which is now the bonus re-triggering symbol, to re-trigger the bonus game as indicated by bonus display 74. The bonus re-trigger may be an alternative to the bonus re-triggers described above or employed in a game in addition to the bonus re-triggers described herein. Each time the player obtains a "D" symbol on one of the paylines 56 during play of the bonus game: the symbol is accumulated to one of the symbol displays 78 in the bonus re-trigger symbol accumulator display 76.

Referring specifically to FIG. 7A, during play of the bonus games, the player obtains the bonus re-triggering symbol "D", designated by the numeral 75, on paylines one and three. In this example, the player can obtain one "D" symbol or a plurality of "D" symbols in each turn or spin. Each "D" symbol obtained by the player is accumulated in the bonus re-trigger symbol accumulator display 76. Therefore, the two "D" symbols obtained by the player in this turn are displayed in the bonus re-trigger symbol accumulator display 76. The player must accumulate or obtain two more "D" symbols to re-trigger the bonus game.

In the player's next turn or spin, the player obtains another "D" symbol as illustrated in FIG. 713. The "D" symbol is accumulated in the bonus re-trigger symbol accumulator display 76. The player only needs to accumulate one more "D" symbol to re-trigger the bonus game.

Referring to FIG. 7C, the player obtains a fourth "D" symbol in the bonus game. The final "D" symbol is accumulated in the bonus re-trigger symbol accumulator display 76 as displayed in each of the symbol displays 78. Thus, a bonus re-trigger is provided to the player.

It should be appreciated that the player could accumulate the predetermined number of bonus re-triggering symbols in a single turn or a plurality of turns. It should also be appreciated that this bonus re-trigger could be employed during one or a plurality of bonus games (including re-triggered bonus games). The bonus re-triggering event illustrated in FIGS. 7A, 7B and 7C may thus be employed with one or more other bonus re-triggering events in a bonus game. It should also be appreciated that this embodiment can also be employed as a sole bonus re-triggering event in a bonus game.

In another embodiment of the present invention, the player must accumulate the bonus re-triggering symbols in a particular order to obtain a bonus re-trigger in the bonus game. In this embodiment, if the player does not accumulate the bonus re-triggering symbols in the specified order, the player does not obtain a bonus re-trigger. Furthermore, the particular combination of bonus re-triggering symbols and the order of the bonus re-triggering symbols may be pre-determined or randomly determined by the processor.

In one embodiment, the player accumulates the bonus re-triggering symbols one at a time. For instance, if the first and second symbols in a predetermined order of the bonus re-triggering symbols appears on one or more paylines during the same turn, the player only accumulates the first bonus re-triggering symbol. The player accumulates the other bonus re-triggering symbols in the specified order in the player's remaining turns in the bonus game. It should be appreciated that a player can accumulate the bonus re-triggering symbols in a pre-determined order during a single turn, or during a plurality of turns in the bonus game.

In a further embodiment, a bonus re-triggering symbol becomes activated in the bonus game. In this embodiment, the accumulator accumulates only the activated bonus re-triggering symbols until a predetermined number of activated bonus re-triggering symbols are obtained in the bonus game. The gaming device then provides the player with a bonus re-trigger as described above.

In another embodiment, the primary and secondary games are operated in a data network such as the internet. In this manner, a player can access and play the primary and secondary games using a personal computer or similar device that has a data network or internet connection.

Accordingly, the present invention provides a gaming device which includes a secondary game triggering event in a primary game which triggers a secondary game, a secondary game re-triggering event in the secondary game which re-triggers the entire secondary game or a portion thereof, wherein the secondary game re-triggering event in the secondary game is more likely to occur in the secondary game than the secondary game triggering event in the primary game. In addition, the gaming device provides another opportunity to re-trigger the secondary game by including a secondary re-triggering symbol accumulator in the secondary game. The accumulator accumulates secondary re-triggering symbols until a pre-determined number of secondary re-triggering symbols are obtained in the secondary game. Preferably, the secondary game re-triggering event in the secondary game and the secondary game triggering event in the primary game employ the same triggering symbols.

Figure 8A:
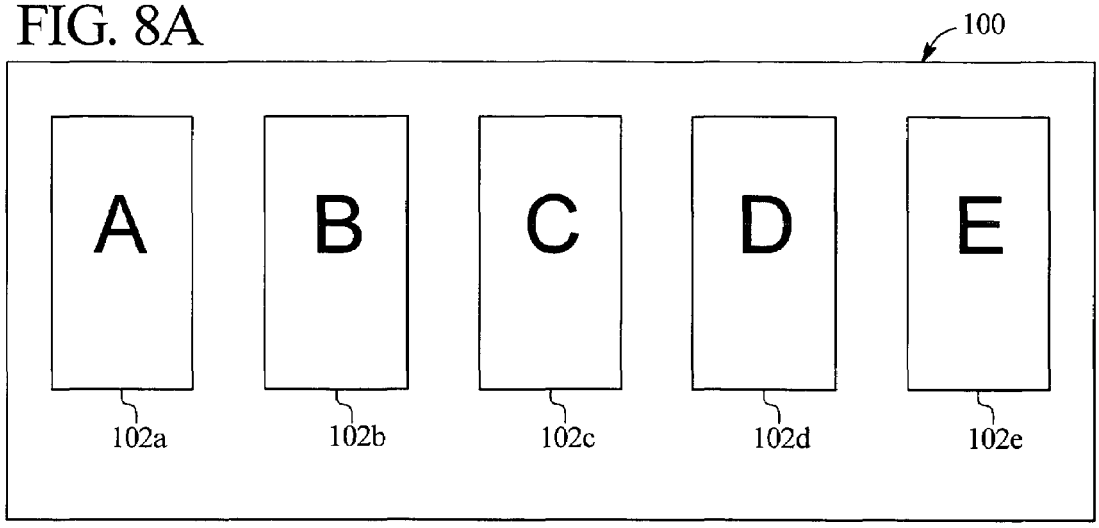
FIGS. 8A, 8B and 8C are front elevation views of an alternative embodiment of the present invention illustrating a player picking one of a plurality of selections to obtain a number of free spins and a threshold level of re-triggering symbols which must be accumulated to re-trigger the secondary game.

Referring to FIG. 8A, in another embodiment of the present invention, the gaming device provides a variable amount of free spins or free activations of the symbol generators or reels as well as a variable threshold amount of accumulator or re-triggering symbols necessary to re-trigger a portion of or the entire secondary game. In this embodiment, upon or after a suitable triggering event, the secondary game is initiated and the gaming device provides a screen or display 100 which enables a player to obtain a number of free spins or activations as well as a threshold of required accumulator or re-triggering symbols required to re-trigger the secondary game. In one embodiment, the gaming device displays a plurality of player selectable selections. Each selection is associated with a number of spins or activations of the reels as well as a number of accumulator or re-triggering symbols necessary to re-trigger the secondary game, however, the number of spins and the number of necessary accumulator symbols associated with each selection is not initially displayed to the player. In this example, the gaming device provides and displays a plurality of player selectable selections 102*a*, 102*b*, 102*c*, 102*d* and 102*e* designated by the letters A, B, C, D and E, respectively.

Figure 8B:
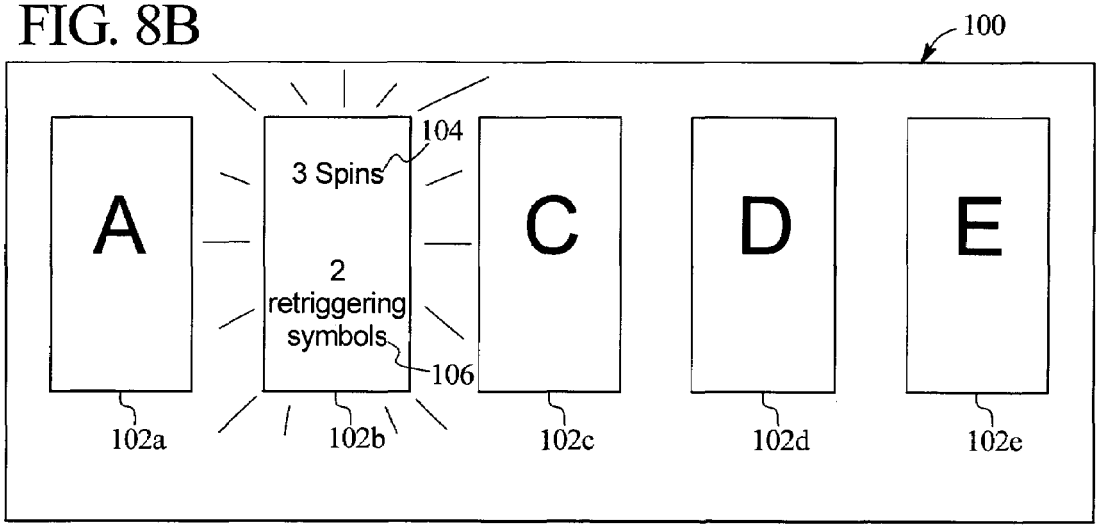

As illustrated in FIG. 8B, the player is enabled to pick one of the plurality of selections and the gaming device reveals the number of spins of the reels and the number of accumulator symbols necessary to re-trigger the secondary game associated with the player picked selection. In this example, the player picked selection 102*b* and the gaming device revealed three spins 104 associated with the player picked selection. The gaming device also revealed two accumulator symbols 106 associated with the player picked selection. As three spins and two accumulator symbols are associated with the player picked selection, the gaming device will provide three spins to the player in which at least two accumulator symbols must be generated and accumulated in order to re-trigger the secondary game as described below.

In one embodiment, each selection is associated with at least one spin and at least one accumulator symbol necessary to re-trigger the secondary game. In another embodiment, at least one selection is associated with a plurality of spins and at least one accumulator symbol necessary to re-trigger the secondary game. In another embodiment, a plurality of selections are each associated with a plurality of spins and at least one accumulator symbol necessary to re-trigger the secondary game. In another embodiment, each selection is associated with a plurality of spins and at least one accumulator symbol necessary to re-trigger the secondary game.

In one embodiment, at least one selection is associated with at least one spin and a plurality of accumulator symbols necessary to re-trigger the secondary game. In another embodiment, a plurality of selections are each associated with at least one spin and a plurality of accumulator symbols necessary to re-trigger the secondary game. In another embodiment, each selection is associated with at least one spin and a plurality of accumulator symbols necessary to re-trigger the secondary game.

In one embodiment, at least one selection is associated with a plurality of spins and a plurality of accumulator symbols necessary to re-trigger the secondary game. In another embodiment, a plurality of selections are each associated with a plurality of spins and a plurality of accumulator symbols necessary to re-trigger the secondary game. In another embodiment, each selection is associated with a plurality of spins and a plurality of accumulator symbols necessary to re-trigger the secondary game.

In different embodiments, the number of spins associated with each selection is predetermined, randomly determined, determined based on the player's wager in a primary game, determined from the occurrence of one or more symbols in a primary game or determined based on any other suitable method. In other different embodiments, the number of accumulator symbols necessary to re-trigger the secondary game associated with each selection is predetermined, randomly determined, determined based on the player's wager in a primary game, determined from the occurrence of one or more symbols in a primary game or determined based on any other suitable method.

Figure 8C:
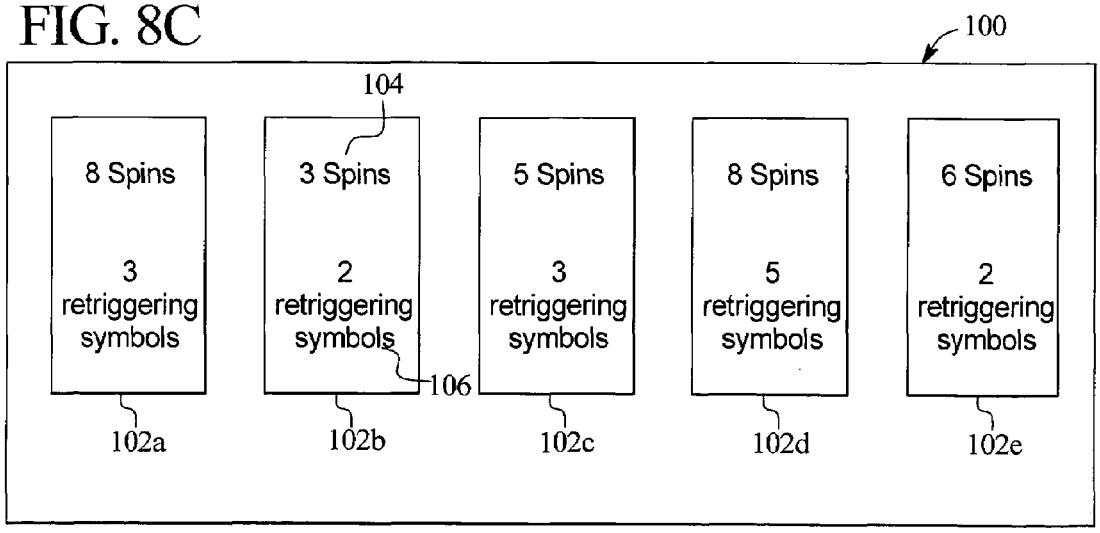

As illustrated in FIG. 8C, after revealing the number of spins and the number of accumulator symbols necessary to re-trigger the secondary game associated with the player picked selection, the gaming device reveals the number of spins and the number of accumulator symbols necessary to re-trigger the secondary game associated with the remaining non-picked selections. This provides increased excitement for the player because the player can view the different thresholds they would have to satisfy to re-trigger the secondary game if they had picked a different selection. In this embodiment, unpicked selection 102*a* is associated with eight spins or activations of the reels as well as three accumulator or re-triggering symbols necessary to re-trigger the secondary game; unpicked selection 102*c* is associated with five spins or activations of the reels as well as three accumulator or re-triggering symbols necessary to re-trigger the secondary game; unpicked selection 102*d* is associated with eight spins or activations of the reels as well as five accumulator or re-triggering symbols necessary to re-trigger the secondary game and unpicked selection 102*e* is associated with six spins or activations of the reels as well as two accumulator or re-triggering symbols necessary to re-trigger the secondary game.

In this embodiment, a plurality of selections may each be associated with the same number of spins of the reels but different numbers of accumulator symbols. For example, selection 102*a* is associated with eight spins and three accumulator symbols while selection 102*d* is associated with eight spins and five accumulator symbols. In this example, if the player picks selection 102*a*, the player has to accumulate less accumulator symbols with the same number of spins then had the player picked selection 102*d* and thus selection 102*a* has a greater probability of ultimately leading to a re-triggering of the secondary game than selection 102*d*.

In this embodiment, a plurality of selections may each be associated with the same number of accumulator or re-triggering symbols but different numbers of spins or activations of the reels. For example, selection 102*a* is associated with eight spins and three accumulator symbols while selection 102*c* is associated with five spins and three accumulator symbols. In this example, if the player picks selection 102*a*, the player has more opportunities or chances (i.e., spins) to accumulate the same number of accumulator symbols and thus selection 102*a* has a greater probability of ultimately leading to a re-triggering of the secondary game than selection 102*c*.

In another embodiment, the different numbers of free activations of the secondary game and the secondary game re-triggering thresholds are not associated with selections, but rather are picked by the gaming device. In one embodiment, the number of free activations of the secondary game and the secondary game re-triggering threshold are randomly picked by the gaming device. In another embodiment, the number of free activations of the secondary game and the secondary game re-triggering threshold are predetermined by the gaming device. It should be appreciated that any suitable method of picking the number of free activations of the secondary game and the secondary game re-triggering threshold may be employed in accordance with the present invention.

In one embodiment, the numbers of free activations of the secondary game are associated with player selectable selections and picked by the player as described above while the secondary game re-triggering threshold is determined by the gaming device. In another embodiment, the number of free activations of the secondary game is determined by the gaming device and the secondary game re-triggering thresholds are associated with player selectable selections and picked by the player as described above. In another embodiment, the gaming device provides the player two sets or groups of selections. The selections in the first group of selections are each associated with a number of free activations of the secondary game and the selections in the second group of selections are each associated with a secondary game re-triggering threshold. In this embodiment, the player selects one of the selections from the first group of selections to reveal a number of provided free activations of the secondary game and the player selects one of the selections from the second group of selections to reveal the provided re-triggering threshold.

Figure 9A:
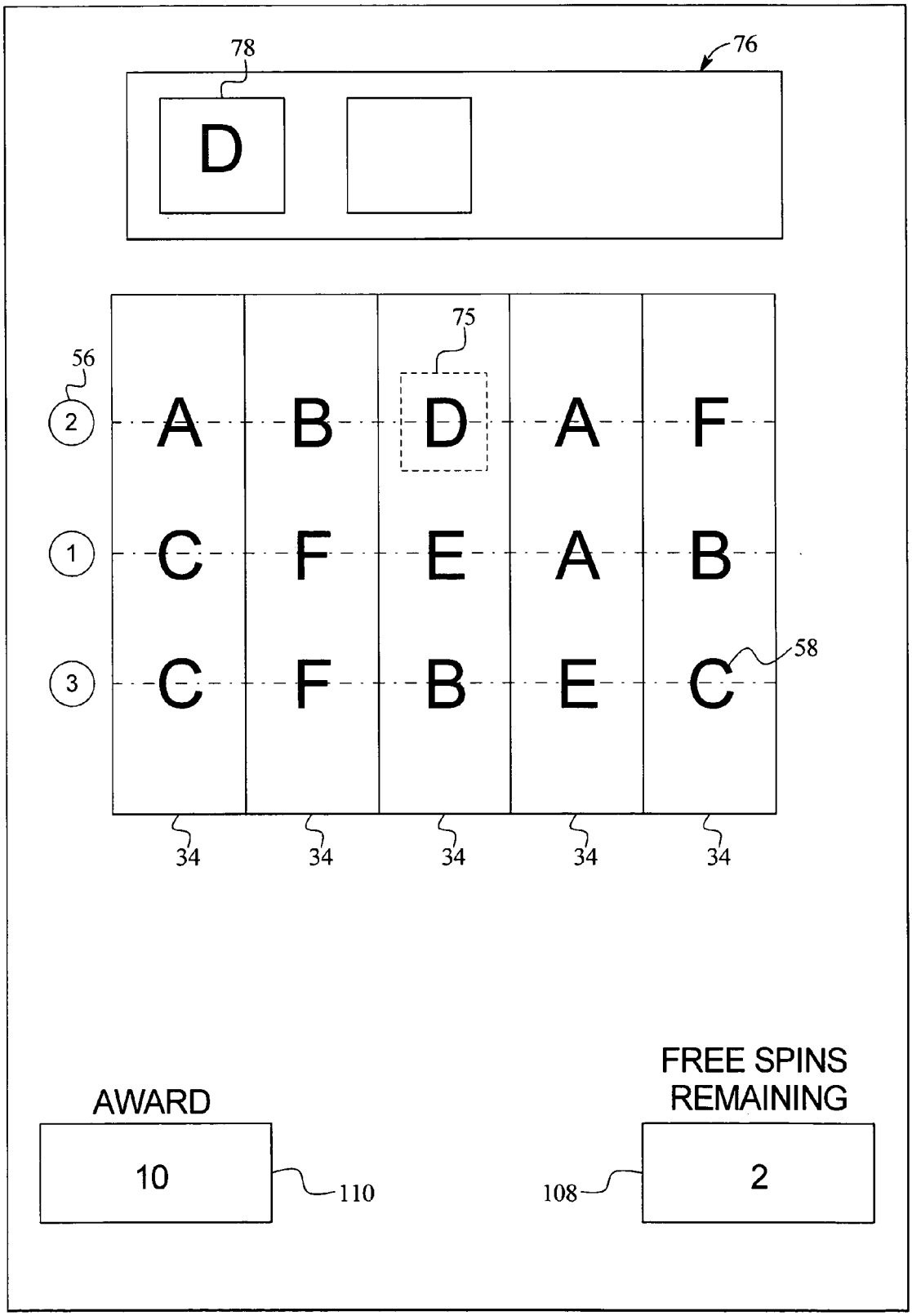
FIGS. 9A, 9B, 9C are front elevation views of an alternative embodiment of the present invention illustrating a plurality of activations of the secondary game with a variable re-triggering threshold for each secondary game.

As illustrated in FIG. 9A, after the player picks the number of free activations to be provided in the secondary game (in this case, three activations displayed in the free spins remaining display 108), and the secondary game re-triggering threshold (in this case, two accumulator symbols designated as "D" symbols), the gaming device proceeds to the symbol generation secondary game as described above. As illustrated in FIG. 9A, for the first of the three provided spins of the symbol generators, the gaming device generated accumulator symbol "D" 75 on the second payline. Accordingly, the gaming device accumulates the generated accumulator or re-triggering symbol and the accumulator or re-trigger display 76 is marked or flagged 78 to reflect one accumulated re-triggering symbol.

It should be appreciated that in addition to determining any generated accumulator symbols, the gaming device also provides the player any award associated with any generated symbol or symbol combination generated on an active payline for this first spin of the reels. In this embodiment, any determined award is provided to the player and displayed in the award display 110. In this case, an award of ten is determined and provided to the player for this first spin of the reels.

In an alternative embodiment, rather than accumulating re-triggering symbols, at least one symbol or symbol combination is associated with a re-triggering event. In this embodiment, after the plurality of symbols are generated, the gaming device determines if the symbol or symbol combination associated with the re-triggering event are generated. If at least one symbol or symbol combination associated with the re-triggering event is generated, the re-trigger display is marked or flagged to reflect one accumulated re-triggering event.

In another embodiment, upon the initiation of the free activation sequence, the player is provided the number of re-triggering symbols associated with the picked selection. In this embodiment, each generated re-triggering symbol reduces the provided number of re-triggering symbols wherein the re-triggering threshold is satisfied if a designated number of re-triggering symbols are reduced. That is, in this embodiment, rather than accumulating generated re-triggering symbols to satisfy the re-triggering threshold, the generated re-triggering symbols are reduced to satisfy the re-triggering threshold.

After providing the player a first of the number of spins or activations provided to the player (i.e., based on the player picked selection), the gaming device determines if any provided spins or activations remain. If at least one provided spin or activation remains, the gaming device proceeds to generate another plurality of symbols on the reels as described above. If no provided spins remain, the gaming device determines if the required number of accumulator symbols necessary to re-trigger the secondary game have been accumulated. If the required number of accumulator symbols have not been accumulated, the gaming device terminates the secondary game. If the required number of accumulated symbols have been accumulated, the gaming device re-triggers the secondary game as described below.

Figure 9B:
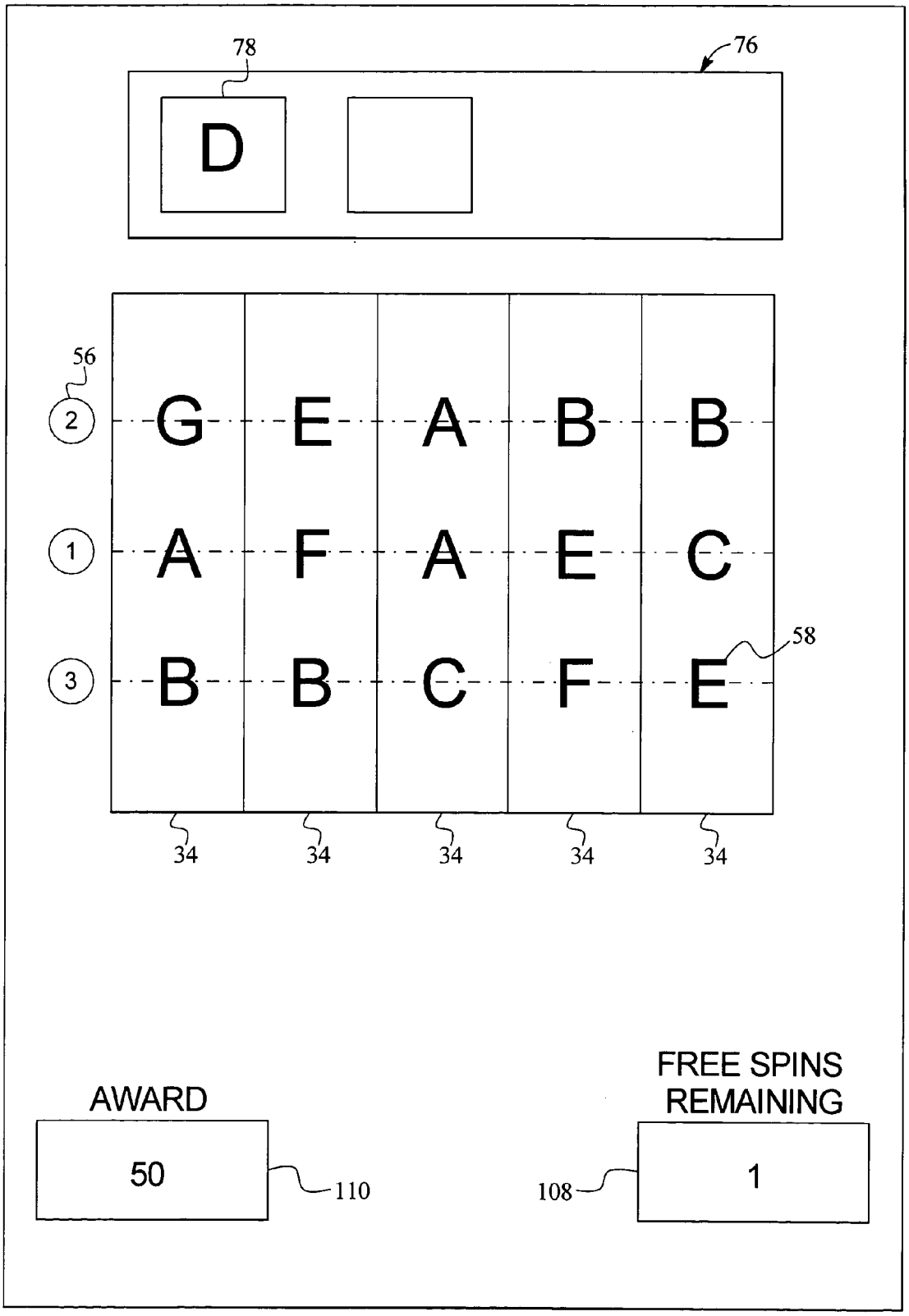

As illustrated in FIG. 9B, since at least one spin or activation remains, the gaming device generates another plurality of symbols on the reels. For this spin, the gaming device does not generate any accumulator symbols and an award of fifty is provided to the player based on the generated symbols.

Figure 9C:
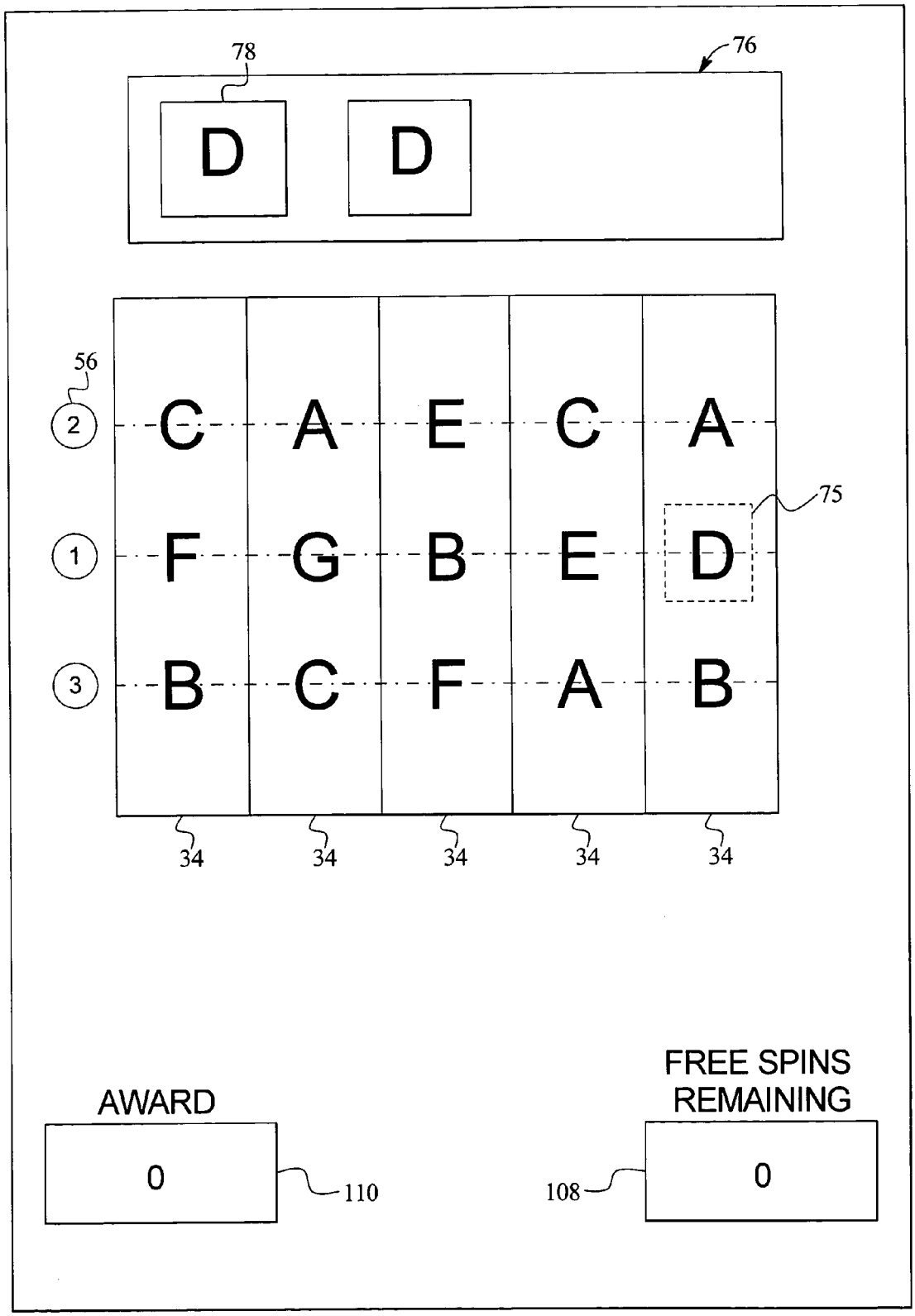

As illustrated in FIG. 9C, since at least one spin or activation remains, the gaming device generates another plurality of symbols on the reels. For this spin, the gaming device generates one accumulator symbol on the first payline and no award based on the generated symbols. Accordingly, the gaming device accumulates the generated accumulator or re-triggering symbol and the accumulator or re-trigger display is marked or, flagged for one accumulated accumulator symbol.

Since no spins or activations of the reels remain, the gaming device determines if the player picked threshold for re-triggering the secondary game is satisfied. That is, the gaming device determines if the required number of accumulator or re-triggering symbols associated with the player picked selection have been accumulated, marked or flagged. If the player picked threshold for re-triggering the secondary game is not satisfied, the secondary game ends. If the player picked threshold for re-triggering the secondary game is satisfied, the gaming device re-triggers the secondary game. In this example, as the player picked threshold of two accumulated re-triggering symbols have been accumulated, the secondary game is retriggered.

In one embodiment, if the player picked threshold of re-triggering the secondary game is satisfied, the gaming device re-triggers the secondary game and proceeds with providing another secondary game as described above. In other words, the gaming device provides the player a plurality of selectable selections which are each associated with a number of spins as well as a number of accumulator symbols necessary to re-trigger the secondary game, enables the player to pick one of the selections, provides the player the number of spins associated with the player picked selection and determines the secondary game re-triggering threshold for the subsequently played secondary game based on the player picked selection. After providing the player a number of activations and determining the secondary game re-triggering threshold, the gaming device provides the number of spins associated with the player picked selection and determines if the player picked re-triggering threshold is satisfied during the provided number of spins as described above.

In one embodiment, if the re-triggering threshold is satisfied and the player has at least one spin or activation of the reels remaining, the gaming device provides any remaining spins or activations of the reels. In this embodiment, the player is provided any awards based on the generated symbols in the remaining activations of the reels. In one embodiment, any re-triggering symbol generated by the remaining activations of the reels function as modifies of any provided awards. In another embodiment, if the re-triggering threshold is satisfied and the player has at least one spin or activation of the reels remaining, the gaming device does not provide any remaining spins or activations of the reels to the player but proceeds to a re-triggering of the secondary game.

In one embodiment, the average number of activations associated with the selections will change with each subsequently provided secondary game. In another embodiment, the average number of activations associated with the selections will remain the same for each subsequently provided secondary game. In one embodiment, the average number of accumulator symbols required to re-trigger the secondary game associated with the selections will change with each subsequently provided secondary game. In another embodiment, the average number of accumulator symbols required to re-trigger the secondary game associated with the selections will remain the same for each subsequently provided secondary game.

In one embodiment (not shown), after a designated number of re-triggers of the secondary game, the gaming device provides the player a plurality of symbols. Each of the symbols is associated with a modifier, such as a multiplier. In this embodiment, the gaming device enables the player to pick one of the symbols and the gaming device reveals the modifier associated with the player picked symbol. Any awards obtained in the secondary game are modified by the revealed modifier and the secondary game ends without a re-triggering of a subsequent secondary game. This embodiment provides a cap or limit to the number of times the secondary game may be sequentially re-triggered and thus a cap or limit to the total award which may be provided to the player. It should be appreciated that in different embodiments, the designated number of secondary games which may be sequentially provided to the player is predetermined, randomly determined, determined based on the player's wager in a primary game, determined from the occurrence of one or more symbols in a primary game or determined based on any other suitable method.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device controlled by a processor, said gaming device comprising:

a game controlled by the processor;

a plurality of symbol generators in said game, wherein said symbol generators includes a plurality of symbols and at least one of said symbols is a re-triggering symbol;

a plurality of selections in said game;

a plurality of different numbers of activations of said symbol generators in said game, wherein each number of activations is associated with one of said selections;

a plurality of different re-triggering thresholds in said game, wherein each retriggering threshold is associated with one of said selections, each re-triggering threshold requires at least one re-triggering symbol and a plurality of re-triggering thresholds each require a different number of re-triggering symbols; and a display device adapted to display said game;

wherein the processor is operable with said symbol generators and said display device to control a play of the game by:

(a) causing one of the selections to be picked;

(b) displaying and providing to a player the number of activations of said symbol generators and the re-triggering threshold associated with the picked selection;

(c) for each provided number of activations of said symbol generators:

(i) causing the symbol generators to generate a plurality of the symbols, (ii) providing the player any award based on the generated symbols, and (iii) accumulating any generated re-triggering symbols;

(d) determining if the provided re-triggering threshold is satisfied, wherein said provided re-triggering threshold is satisfied based on the accumulated re-triggering symbols and the number of re-triggering symbols required for the provided re-triggering threshold;

(e) if the provided re-triggering threshold is not satisfied, causing a terminating event to occur; and (f) if the provided re-triggering threshold is satisfied, repeating (a) to (f) at least once.

2. The gaming device of claim 1, wherein the selections are picked by the player.

3. The gaming device of claim 1, wherein each of the re-triggering thresholds requires a different number of re-triggering symbols.

4. The gaming device of claim 1, wherein the plurality of symbols includes a plurality of re-triggering symbols.

5. The gaming device of claim 1, wherein the processor is operable to control the play of the game by repeating (a) to (f) a designated number of times if a predetermined number of provided re-triggering thresholds are satisfied.

6. The gaming device of claim 5, wherein if (a) to (f) are repeated the designated number of times, any provided awards are modified by a modifier.

7. The gaming device of claim 1, wherein said symbol generators include reels.

8. A gaming device controlled by a processor, said gaming device comprising:

a game controlled by the processor;

a plurality of symbols in said game, wherein at least one of said symbols is a re-triggering symbol;

a plurality of selections in said game;

a plurality of different re-triggering thresholds in said game, wherein each retriggering threshold is associated with one of said selections, each re-triggering threshold requires at least one re-triggering symbol and a plurality of re-triggering thresholds each require a different number of re-triggering symbols;

a plurality of different numbers of re-triggering attempts in said game, wherein each number of re-triggering attempts is associated with one of said selections;

a display device adapted to display said game;

wherein the processor is operable with said display device to control a play of the game by:

(a) causing one of the selections to be picked;

(b) displaying and providing to a player the number of re-triggering attempts and the re-triggering threshold associated with the picked selection;

(c) for each provided number of re-triggering attempts:

(i) generating and providing a plurality of the symbols, (ii) providing the player any award based on the generated symbols, and (iii) accumulating any generated re-triggering symbols;

(d) determining if the provided re-triggering threshold is satisfied, wherein said provided re-triggering threshold is satisfied based on the accumulated re-triggering symbols and the number of re-triggering symbols required for the provided re-triggering threshold;

(e) if the provided re-triggering threshold is not satisfied, causing a terminating event to occur; and (f) if the provided re-triggering threshold is satisfied, repeating (a) to (f) at least once.

9. The gaming device of claim 8, wherein the selections are picked by the player.

10. The gaming device of claim 8, wherein each of the re-triggering thresholds require a different number of re-triggering symbols.

11. The gaming device of claim 8, wherein the plurality of symbols includes a plurality of re-triggering symbols.

12. The gaming device of claim 8, wherein the processor is operable to control the play of the game by repeating (a) to (f) a designated number of times if a predetermined number of provided re-triggering thresholds are satisfied.

13. The gaming device of claim 12, wherein if (a) to (f) are repeated the designated number of times, any provided awards are modified by a modifier.

14. A gaming device controlled by a processor, said gaming device comprising:

a primary game controlled by the processor;

a secondary game controlled by the processor;

a secondary game triggering event;

a plurality of symbol generators in the secondary game, wherein said symbol generators includes a plurality of symbols and at least one of said symbols is a re-triggering symbol;

a plurality of selections in said secondary game;

a plurality of different numbers of activations of said symbol generators in said secondary game, wherein each number of activations is associated with one of said selections;

a plurality of different required numbers of re-triggering symbols in the secondary game, wherein each different required number of retriggering symbols is associated with one of said selections;

a selector in the secondary game operable to cause a pick of one of said selections; and an accumulator in the secondary game which is adapted to accumulate re-triggering symbols, wherein a secondary game re-trigger is provided if, during the number of activations of said symbol generators associated with the picked selection, the accumulator accumulates the required number of re-triggering symbols associated with the picked selection.

15. The gaming device of claim 14, wherein the selector is operable to enable the player to pick one of said selections.

16. The gaming device of claim 14, wherein the secondary game re-triggering event in the secondary game and the secondary game triggering event in the primary game employ the same triggering symbol.

17. The gaming device of claim 14, which includes an accumulated symbol display that displays the secondary game re-triggering symbols that are accumulated by the player in the symbol generations of the secondary games.

18. The gaming device of claim 14, wherein said symbol generators include reels.

19. A gaming device controlled by a processor, said gaming device comprising:

a game controlled by the processor;

a plurality of symbol generators in said game, wherein said symbol generators includes a plurality of symbols and at least one of said symbols is a re-triggering symbol;

a plurality of different numbers of activations of said symbol generators in said game; and a plurality of different re-triggering thresholds in said game, wherein each re-triggering threshold requires at least one re-triggering symbol and a plurality of re-triggering thresholds each require a different number of re-triggering symbols;

wherein the processor is operable with said symbol generators to control a play of the game by:

(a) causing one of the different numbers of activations of said symbol generators and one of the different re-triggering thresholds to be picked;

(b) providing to a player the picked number of activations of said symbol generators and the picked re-triggering threshold;

(c) for each provided number of activations of said symbol generators:

(i) causing the symbol generators to generate a plurality of the symbols, (ii) providing the player any award based on the generated symbols, and (iii) accumulating any generated re-triggering symbols;

(d) determining if the provided re-triggering threshold is satisfied, wherein said provided re-triggering threshold is satisfied based on the accumulated re-triggering symbols and the number of re-triggering symbols required for the provided re-triggering threshold;

(e) if the provided re-triggering threshold is not satisfied, causing a terminating event to occur; and (f) if the provided re-triggering threshold is satisfied, repeating (a) to (f) at least once.

20. The gaming device of claim 19, wherein each of the re-triggering thresholds requires a different number of re-triggering symbols.

21. The gaming device of claim 19, wherein the plurality of symbols includes a plurality of re-triggering symbols.

22. The gaming device of claim 19, wherein the processor is operable to control the play of the game by repeating (a) to (f) a designated number of times if a predetermined number of provided re-triggering thresholds are satisfied.

23. The gaming device of claim 22, wherein if (a) to (f) are repeated the designated number of times, any provided awards are modified by a modifier.

24. The gaming device of claim 19, wherein said symbol generators include reels.

25. A gaming device controlled by a processor, said gaming device comprising:

a game controlled by the processor;

a plurality of symbol generators in said game, wherein said symbol generators includes a plurality of symbols and at least one of said symbols is a re-triggering symbol;

a plurality of selections in said game;

a plurality of different numbers of activations of said symbol generators in said game, wherein each number of activations is associated with one of said selections;

a plurality of different re-triggering thresholds in said game, wherein each re-triggering threshold requires at least one re-triggering symbol and a plurality of re-triggering thresholds each require a different number of re-triggering symbols; and a display device adapted to display said game;

wherein the processor is operable with said symbol generators and said display device to control a play of the game by:

(a) causing one of the selections to be picked;

(b) displaying and providing to a player the number of activations of said symbol generators associated with the picked selection;

(c) displaying and providing one of the different re-triggering thresholds;

(d) for each provided number of activations of said symbol generators:

(i) causing the symbol generators to generate a plurality of the symbols, (ii) providing the player any award based on the generated symbols, and (iii) accumulating any generated re-triggering symbols;

(e) determining if the provided re-triggering threshold is satisfied, wherein said provided re-triggering threshold is satisfied based on the accumulated re-triggering symbols and the number of re-triggering symbols required for the provided re-triggering threshold;

(f) if the provided re-triggering threshold is not satisfied, causing a terminating event to occur; and (g) if the provided re-triggering threshold is satisfied, repeating (a) to (g) at least once.

26. The gaming device of claim 25, wherein the selections are picked by the player.

27. The gaming device of claim 25, wherein each of the re-triggering thresholds requires a different number of re-triggering symbols.

28. The gaming device of claim 25, wherein the plurality of symbols includes a plurality of re-triggering symbols.

29. The gaming device of claim 25, wherein the processor is operable to control the play of the game by repeating (a) to (g) a designated number of times if a predetermined number of provided re-triggering thresholds are satisfied.

30. The gaming device of claim 29, wherein if (a) to (g) are repeated the designated number of times, any provided awards are modified by a modifier.

31. A gaming device controlled by a processor, said gaming device comprising:

a game controlled by the processor;

a plurality of symbol generators in said game, wherein said symbol generators includes a plurality of symbols and at least one of said symbols is a re-triggering symbol;

a plurality of selections in said game;

a plurality of different numbers of activations of said symbol generators in said game;

a plurality of different re-triggering thresholds in said game, wherein each retriggering threshold is associated with one of said selections, each re-triggering threshold requires at least one re-triggering symbol and a plurality of re-triggering thresholds each require a different number of re-triggering symbols; and a display device adapted to display said game;

wherein the processor is operable with said symbol generators and said display device to control a play of the game by:

(a) causing one of the selections to be picked;

(b) displaying and providing to a player the re-triggering threshold associated with the picked selection;

(c) providing to the player one of said numbers of activations of said symbol generators;

(d) for each provided number of activations of said symbol generators:

(i) causing the symbol generators to generate a plurality of the symbols, (ii) providing the player any award based on the generated symbols, and (iii) accumulating any generated re-triggering symbols;

(e) determining if the provided re-triggering threshold is satisfied, wherein said provided re-triggering threshold is satisfied based on the accumulated re-triggering symbols and the number of re-triggering symbols required for the provided re-triggering threshold;

(f) if the provided re-triggering threshold is not satisfied, causing a terminating event to occur; and (g) if the provided re-triggering threshold is satisfied, repeating (a) to (g) at least once.

32. The gaming device of claim 31, wherein the selections are picked by the player.

33. The gaming device of claim 31, wherein each of the re-triggering thresholds requires a different number of re-triggering symbols.

34. The gaming device of claim 31, wherein the plurality of symbols includes a plurality of re-triggering symbols.

35. The gaming device of claim 31, wherein the processor is operable to control the play of the game by repeating (a) to (g) a designated number of times if a predetermined number of provided re-triggering thresholds are satisfied.

36. The gaming device of claim 35, wherein if (a) to (g) are repeated the designated number of times, any provided awards are modified by a modifier.

37. A method of operating a gaming device, said method comprising:

(a) causing one of a plurality of selections to be picked, wherein said picked selection is associated with one of a plurality of different numbers of activations of a plurality of symbol generators and one of a plurality of different re-triggering thresholds, wherein each re-triggering threshold requires at least one re-triggering symbol and a plurality of re-triggering thresholds each require a different number of re-triggering symbols;

(b) displaying and providing to a player the number of activations of said symbol generators and the re-triggering threshold associated with the picked selection;

(c) for each provided number of activations of said symbol generators:

(i) causing the symbol generators to generate a plurality of symbols, (ii) providing the player any award based on the generated symbols, and (iii) accumulating any generated re-triggering symbols;

(d) determining if the provided re-triggering threshold is satisfied, wherein said provided re-triggering threshold is satisfied based on the accumulated re-triggering symbols and the number of re-triggering symbols required for the provided re-triggering threshold;

(e) if the provided re-triggering threshold is not satisfied, causing a terminating event to occur; and (f) if the provided re-triggering threshold is satisfied, repeating (a) to (f) at least once.

38. The method of claim 37, wherein the selections are picked by the player.

39. The method of claim 37, wherein each of the re-triggering thresholds requires a different number of re-triggering symbols.

40. The method of claim 37, wherein the plurality of symbols includes a plurality of re-triggering symbols.

41. The method of claim 37, which includes repeating (a) to (f) a designated number of times if a predetermined number of provided re-triggering thresholds are satisfied.

42. The method of claim 41, wherein if (a) to (f) are repeated the designated number of times, any provided awards are modified by a modifier.

43. The method of claim 37, wherein said steps are provided to the player through a data network.

44. The method of claim 43, wherein the data network is an Internet.

45. A method of operating a gaming device, said method comprising:

(a) causing one of a plurality of selections to be picked, wherein each selection is associated with one of a plurality of different numbers of re-triggering attempts and one of a plurality of different re-triggering thresholds, wherein each re-triggering threshold requires at least one re-triggering symbol and a plurality of re-triggering thresholds each require a different number of re-triggering symbols;

(b) displaying and providing to a player the number of re-triggering attempts and the re-triggering threshold associated with the picked selection;

(c) for each provided number of re-triggering attempts:

(i) generating and providing a plurality of symbols, (ii) providing the player any award based on the generated symbols, and (iii) accumulating any generated re-triggering symbols;

(d) determining if the provided re-triggering threshold is satisfied, wherein said provided re-triggering threshold is satisfied based on the accumulated re-triggering symbols and the number of re-triggering symbols required for the provided re-triggering threshold;

(e) if the provided re-triggering threshold is not satisfied, causing a terminating event to occur; and (f) if the provided re-triggering threshold is satisfied, repeating (a) to (f) at least once.

46. The method of claim 45, wherein the selections are picked by the player.

47. The method of claim 45, wherein each of the re-triggering thresholds requires a different number of re-triggering symbols.

48. The method of claim 45, wherein the plurality of symbols includes a plurality of re-triggering symbols.

49. The method of claim 45, which includes repeating (a) to (f) a designated number of times if a predetermined number of provided re-triggering thresholds are satisfied.

50. The method of claim 49, wherein if (a) to (f) are repeated the designated number of times, any provided awards are modified by a modifier.

51. The method of claim 45, wherein said steps are provided to the player through a data network.

52. The method of claim 51, wherein the data network is an Internet.

53. A method of operating a gaming device, said method comprising:

(a) causing one of a plurality of different numbers of activations of a plurality of symbol generators and one of a plurality of different re-triggering thresholds to be picked, wherein each re-triggering threshold requires at least one re-triggering symbol and a plurality of re-triggering thresholds each require a different number of re-triggering symbols;

(b) displaying and providing to a player the picked number of activations of said symbol generators and the picked re-triggering threshold;

(c) for each provided number of activations of said symbol generators:

(i) causing the symbol generators to generate a plurality of symbols, (ii) providing the player any award based on the generated symbols, and (iii) accumulating any generated re-triggering symbols;

(d) determining if the provided re-triggering threshold is satisfied, wherein said provided re-triggering threshold is satisfied based on the accumulated re-triggering symbols and the number of re-triggering symbols required for the provided re-triggering threshold;

(e) if the provided re-triggering threshold is not satisfied, causing a terminating event to occur; and (f) if the provided re-triggering threshold is satisfied, repeating (a) to (f) at least once.

54. The method of claim 53, wherein each of the re-triggering thresholds requires a different number of re-triggering symbols.

55. The method of claim 53, wherein the plurality of symbols includes a plurality of re-triggering symbols.

56. The method of claim 53, which includes repeating (a) to (f) a designated number of times if a predetermined number of provided re-triggering thresholds are satisfied.

57. The method of claim 56, wherein if (a) to (f) are repeated the designated number of times, any provided awards are modified by a modifier.

58. The method of claim 53, wherein said steps are provided to the player through a data network.

59. The method of claim 58, wherein the data network is an Internet.

60. A method of operating a gaming device, said method comprising:

(a) causing one of a plurality of selections to be picked, wherein said picked selection is associated with one of a plurality of different numbers of activations of a plurality of symbol generators;

(b) displaying and providing to a player the number of activations of said symbol generators associated with the picked selection;

(c) displaying and providing one of a plurality of different re-triggering thresholds, wherein each re-triggering threshold requires at least one re-triggering symbol and a plurality of re-triggering thresholds each require a different number of re-triggering symbols;

(d) for each provided number of activations of said symbol generators:

(i) causing the symbol generators to generate a plurality of symbols, (ii) providing the player any award based on the generated symbols, and (iii) accumulating any generated re-triggering symbols;

(e) determining if the provided re-triggering threshold is satisfied, wherein said provided re-triggering threshold is satisfied based on the accumulated re-triggering symbols and the number of re-triggering symbols required for the provided re-triggering threshold;

(f) if the provided re-triggering threshold is not satisfied, causing a terminating event to occur; and (g) if the provided re-triggering threshold is satisfied, repeating (a) to (g) at least once.

61. The method of claim 60, wherein the selections are picked by the player.

62. The method of claim 60, wherein each of the re-triggering thresholds requires a different number of re-triggering symbols.

63. The method of claim 60, wherein the plurality of symbols includes a plurality of re-triggering symbols.

64. The method of claim 60, which includes repeating (a) to (g) a designated number of times if a predetermined number of provided re-triggering thresholds are satisfied.

65. The method of claim 64, wherein if (a) to (g) are repeated the designated number of times, any provided awards are modified by a modifier.

66. The method of claim 60, wherein said steps are provided to the player through a data network.

67. The method of claim 66, wherein the data network is an Internet.

68. A method of operating a gaming device, said method comprising:

(a) causing one of a plurality of selections to be picked, wherein said picked selection is associated with one of a plurality of different re-triggering thresholds, wherein each re-triggering threshold requires at least one re-triggering symbol and a plurality of re-triggering thresholds each require a different number of re-triggering symbols;

(b) displaying and providing to a player the re-triggering threshold associated with the picked selection;

(c) providing one of a plurality of different numbers of activations of a plurality of symbol generators;

(d) for each provided number of activations of said symbol generators:

(i) causing the symbol generators to generate a plurality of symbols, (ii) providing the player any award based on the generated symbols, and (iii) accumulating any generated re-triggering symbols;

(e) determining if the provided re-triggering threshold is satisfied, wherein said provided re-triggering threshold is satisfied based on the accumulated re-triggering symbols and the number of re-triggering symbols required for the provided re-triggering threshold;

(f) if the provided re-triggering threshold is not satisfied, causing a terminating event to occur; and (g) if the provided re-triggering threshold is satisfied, repeating (a) to (g) at least once.

69. The method of claim 68, wherein the selections are picked by the player.

70. The method of claim 68, wherein each of the re-triggering thresholds requires a different number of re-triggering symbols.

71. The method of claim 68, wherein the plurality of symbols includes a plurality of re-triggering symbols.

72. The method of claim 68, which includes repeating (a) to (g) a designated number of times if a predetermined number of provided re-triggering thresholds are satisfied.

73. The method of claim 72, wherein if (a) to (g) are repeated the designated number of times, any provided awards are modified by a modifier.

74. The method of claim 68, wherein said steps are provided to the player through a data network.

75. The method of claim 74, wherein the data network is an Internet.

* * * * *